US012180684B2

(12) United States Patent
Kidani et al.

(10) Patent No.: US 12,180,684 B2
(45) Date of Patent: Dec. 31, 2024

(54) PIPE PROTECTION UNIT IN WORK MACHINE

(71) Applicant: KOBELCO CONSTRUCTION MACHINERY CO., LTD., Hiroshima (JP)

(72) Inventors: Tomonori Kidani, Hiroshima (JP); Ichiro Wada, Hiroshima (JP); Hiroki Tanaka, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 469 days.

(21) Appl. No.: 17/656,092

(22) Filed: Mar. 23, 2022

(65) Prior Publication Data

US 2022/0333351 A1 Oct. 20, 2022

(30) Foreign Application Priority Data

Apr. 16, 2021 (JP) ..... 2021-069834

(51) Int. Cl.
*E02F 9/22* (2006.01)

(52) U.S. Cl.
CPC ..... *E02F 9/2275* (2013.01)

(58) Field of Classification Search
CPC ..... B60D 1/62; E02F 9/2275
See application file for complete search history.

(56) References Cited

U.S. PATENT DOCUMENTS 3,777,824 A * 12/1973 Anderson ..... E02F 9/2271 172/813
3,901,270 A * 8/1975 Smith ..... B60D 1/62 248/75
4,304,077 A 12/1981 Muller
2014/0075929 A1* 3/2014 Luvaas ..... E02F 9/2292 60/413

(Continued)

FOREIGN PATENT DOCUMENTS

GB 2 178 139 A 2/1987
JP 62-49002 A 3/1987

(Continued)

OTHER PUBLICATIONS

Extended European Search Report issued Sep. 28, 2022 in European Patent Application No. 22164944.5, 8 pages.

*Primary Examiner* — P. Macade Nichols
(74) *Attorney, Agent, or Firm* — Oblon, McClelland, Maier & Neustadt, L.L.P.

(57) ABSTRACT

A pipe protection unit includes: at least one inner low-pressure pipe which is a hydraulic pipe disposed along an attachment side surface which is one of a left side surface and a right side surface of a work attachment; at least one outer high-pressure pipe disposed along the attachment side surface at an outer position than the at least one inner low-pressure pipe, the at least one outer high-pressure pipe having an outer diameter larger than an outer diameter of the at least one inner low-pressure pipe; and a cover plate which is a plate that is disposed along the attachment side surface so as to be interposed between the at least one inner low-pressure pipe and the at least one outer high-pressure pipe and is supported by the work attachment, the cover plate covering at least a part of the at least one inner low-pressure pipe.

9 Claims, 13 Drawing Sheets

(56) References Cited

U.S. PATENT DOCUMENTS

| | | | | |
|---|---|---|---|---|
| 2021/0022285 | A1* | 1/2021 | Graber | E02F 3/407 |
| 2021/0025125 | A1 | 1/2021 | Wada et al. | |

FOREIGN PATENT DOCUMENTS

| | | | |
|---|---|---|---|
| JP | 10-331184 | A | 12/1998 |
| JP | 2007-262778 | A | 10/2007 |
| JP | 2011-236653 | A | 11/2011 |
| JP | 2013-96161 | A | 5/2013 |
| JP | 2021-21229 | A | 2/2021 |
| WO | WO 2019/221876 | A1 | 11/2019 |

* cited by examiner

PIPE PROTECTION UNIT IN WORK MACHINE

TECHNICAL FIELD

The present disclosure relates to a pipe protection unit in a work machine.

BACKGROUND ART

The work machine generally includes a base machine capable of travelling on the ground, and a work attachment attached to the base machine. The work attachment includes a boom mounted on the base machine so as to be raised and lowered, an arm rotatably mounted on a distal end portion of the boom, a distal end work device mounted on a distal end portion of the arm, and a plurality of cylinders for operating the boom, the arm, and the distal end work device.

For example, JP 2007-262778 A, JP 2011-236653 A, and JP 2013-96161 A disclose work machines for performing work at a high place away from the ground, for example, building demolishing work. In these work machines, a plurality of piping circuits are arranged along a work attachment, and hydraulic oil is supplied to the plurality of cylinders through the plurality of piping circuits. The plurality of piping circuits for supplying the hydraulic oil to the plurality of cylinders are high-pressure piping circuits having strength that enables withstanding to a large pressure of the hydraulic oil according to a large load during work by the work attachment.

However, there may be a case where not only the high-pressure piping circuit as described above is disposed along the work attachment, but also a low-pressure piping circuit may be disposed along the work attachment. Examples of the low-pressure piping circuit include a low-pressure piping circuit for supplying hydraulic oil to a quick hitch which is a device for replacing a part of a plurality of components constituting the work attachment, and a low-pressure piping circuit for supplying hydraulic oil to a device for inserting and removing a pin that connects two adjacent components among the plurality of components constituting the work attachment. Since a low-pressure piping circuit does not require pressure resistance unlike the high-pressure piping circuit, the low-pressure piping circuit has a smaller outer diameter and lower strength than the high-pressure piping circuit. Therefore, it is desirable to take measures to protect the low-pressure piping circuit from an impact that may be applied to the low-pressure piping circuit during work such as demolishing work by the work machine.

Further, in a case where a work attachment is relatively large, the work attachment is configured to be dividable into a plurality of attachment portions so as not to exceed a dimensional limit at the time of transportation. In this case, each of the high-pressure piping circuit and the low-pressure piping circuit disposed along the work attachment is configured to be dividable into a plurality of pipes. Therefore, in order to facilitate disassembling work and assembling work of the work attachment, it is desirable that the high-pressure piping circuit and the low-pressure piping circuit are disposed not on an upper surface of the work attachment but on one or both of a right side surface and a left side surface of the work attachment.

JP 2011-236653 A discloses a front attachment of a work machine having a configuration in which a plurality of hydraulic pipes disposed on an upper surface of a boom are covered with a handrail having a step and a cover and a fixed fence. The technique of JP 2011-236653 A is premised on that the plurality of hydraulic pipes are disposed along an upper surface of the work attachment. Therefore, in a case where a high-pressure piping circuit and a low-pressure piping circuit are disposed on a right side surface or a left side surface of a work attachment, it is difficult to apply the technique of JP 2011-236653 A.

JP 2013-96161 A discloses a work machine in which a pipe is disposed on a side of a work attachment along a longitudinal direction of the work attachment, and the pipe is disposed on an upper side of a greasing distribution valve so as to prevent a falling object from above from colliding against the greasing distribution valve. In the work machine of JP 2013-96161 A, a gap is always generated between two adjacent pipes disposed on the upper side of the greasing distribution valve. Therefore, there is room for improvement in the technique of JP 2013-96161 A.

SUMMARY OF INVENTION

The present disclosure has been made in view of the above problems, and an object of the present disclosure is to provide a pipe protection unit enabling a low-pressure pipe to be protected in a work machine.

Provided is a pipe protection unit in a work machine including a base machine and a work attachment supported by the base machine, the pipe protection unit including: at least one inner low-pressure pipe which is a hydraulic pipe disposed along an attachment side surface which is one of a left side surface and a right side surface of the work attachment; at least one outer high-pressure pipe which is a hydraulic pipe disposed along the attachment side surface at an outer position than the at least one inner low-pressure pipe, the at least one outer high-pressure pipe having an outer diameter larger than an outer diameter of the at least one inner low-pressure pipe; and a cover plate which is a plate that is disposed along the attachment side surface so as to be interposed between the at least one inner low-pressure pipe and the at least one outer high-pressure pipe and is supported by the work attachment, the cover plate covering at least a part of the at least one inner low-pressure pipe.

DESCRIPTION OF EMBODIMENTS

Embodiments of the present disclosure will be described with reference to the drawings.

Figure 1:
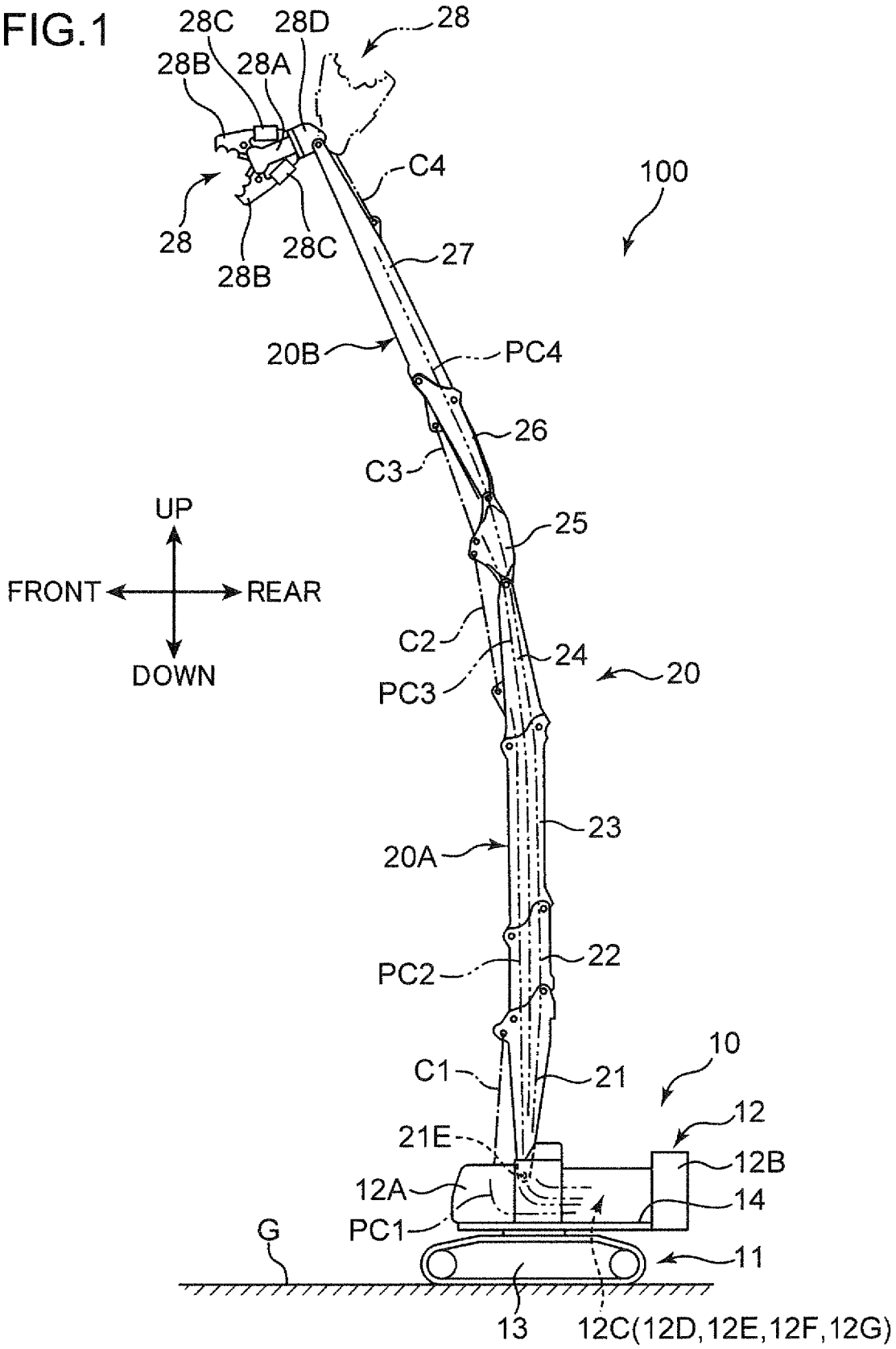
FIG. 1 is a side view illustrating a work machine including a pipe protection unit according to an embodiment of the present disclosure.

A work machine 100 illustrated in FIG. 1 is a demolition machine for performing demolishing work. The work machine 100 includes a base machine 10 and a work attachment 20.

The base machine 10 includes a lower travelling body 11 and an upper slewing body 12. The lower travelling body 11 includes a lower frame (not illustrated) and a pair of crawler travelling devices 13 arranged on the left and right of the lower frame, and is capable of travelling on the ground G by the operation of the crawler travelling device 13. The upper stewing body 12 includes a slewing frame 14 and a plurality of slewing elements mounted thereon. The stewing frame 14 is mounted on the lower frame of the lower travelling body 11 so as to be slewable about a vertical axis. The plurality of slewing elements include a cab 12A, a counterweight 1213, a machine room 12C, and the like. In the cab 12A, a driver's seat on which an operator sits, a pair of left and right operation levers operated by the operator, and the like are disposed. In the machine room 12C, there are disposed a prime mover 12D such as an engine, at least one hydraulic pump 12E driven by the prime mover 12D, a control valve unit 12F that controls a flow of hydraulic oil from the hydraulic pump 12E to each of a plurality of hydraulic cylinders C1 to C4 to be described later, a tank 12G into which hydraulic oil from the plurality of hydraulic cylinders C1 to C4 returns, and the like.

"Upper", "lower", "front", "rear", and "right" directions illustrated in the drawings are based on an orientation of the upper slewing body 12 of the work machine 100. Specifically, the front-rear direction is a horizontal direction based on an orientation of the driver's seat disposed in the cab 12A of the upper slewing body 12, and the left-right direction is a horizontal direction orthogonal to the front-rear direction.

The work attachment 20 includes a boom 20A attached to the upper slewing body 12 so as to be raised and lowered, a coupling member 25 (inter-boom) rotatably attached to the boom 20A, an arm 20B rotatably attached to the coupling member 25, and a distal end work device 28. The boom 20A includes at least one boom component. The arm 20B includes at least one arm component.

The work attachment 20 is long in an upright state in order to enable work at a high place by the distal end work device 28. The work attachment 20 is configured to be dividable into a plurality of portions so as not to exceed a dimensional limit at the time of transportation.

In the present embodiment, the at least one boom component includes a first boom component 21, a second boom component 22, a third boom component 23, and a fourth boom component 24, and the at least one arm component includes a first arm component 26 and a second arm component 27. The plurality of boom components 21 to 24 are disposed in series in this order and coupled to each other to form the boom 20A. The plurality of arm components 26 and 27 are disposed in series in this order and coupled to each other to form the arm 20B. The boom 20A, the coupling member 25, the arm 20B, and the distal end work device 28 are disposed in series in this order and coupled to each other to form the work attachment 20. The plurality of boom components 21 to 24 are attachable to and detachable from each other, and the plurality of arm components 26 and 27 are attachable to and detachable from each other.

The boom 20A has a proximal end portion and a distal end portion opposite to the proximal end portion, and has a shape extending from the proximal end portion toward the distal end portion. In the present embodiment, the proximal end portion of the boom 20A is a proximal end portion 21E of the first boom component 21, and the distal end portion of the boom 20A is a distal end portion of the fourth boom component 24. The proximal end portion of the boom 20A is coupled to the base machine 10 via a pin so as to be rotatable about a boom rotation axis extending in the left-right direction. As a result, the boom 20A can rotate in a raising and lowering direction, that is, an up-down direction with respect to the base machine 10. The proximal end portion of the boom 20A is attachable to and detachable from the base machine 10.

The coupling member 25 has a proximal end portion and a distal end portion opposite to the proximal end portion. The proximal end portion of the coupling member 25 is coupled to the distal end portion of the boom 20A via a pin so as to be rotatable about a coupling member rotation axis extending in the left-right direction. This enables the coupling member 25 to rotate with respect to the boom 20A. The proximal end portion of the coupling member 25 is attachable to and detachable from the distal end portion of the boom 20A.

The arm 20B has a proximal end portion and a distal end portion opposite to the proximal end portion, and has a shape extending from the proximal end portion toward the distal end portion. In the present embodiment, the proximal end portion of the arm 20B is a proximal end portion of the first arm component 26, and the distal end portion of the arm 20B is a distal end portion of the second arm component 27. The proximal end portion of the arm 20B is coupled to the distal end portion of the coupling member 25 via a pin so as to be rotatable about an arm rotation axis extending in the left-right direction. This enables the arm 20B to rotate with respect to the coupling member 25. The proximal end portion of the min 20B is attachable to and detachable from the distal end portion of the coupling member 25.

The distal end work device 28 is rotatably coupled to the distal end portion of the arm 20B with respect to the arm 20B. The distal end work device 28 according to the present embodiment is a so-called crusher, and includes a crusher main body 28A, a pair of crushing blades 28B and 28B, a pair of crushing cylinders 28C and 28C, and a link mechanism 28D. The link mechanism 28D couples the crusher main body 28A and the distal end portion of the arm 20B such that the crusher main body 28A is rotatable about a work device rotation axis extending in the left-right direction with respect to the distal end portion of the arm 20B. A proximal end portion of the distal end work device 28, specifically, a proximal end portion of the link mechanism 28D is attachable to and detachable from the distal end portion of the arm 20B. The crusher main body 28A supports the pair of crushing blades 28B and 28B so as to be opened and closed, that is, so as to be rotatable about axes parallel to each other. Each of the pair of crushing cylinders 28C and 28C is interposed between each of the pair of crushing blades 28B and 28B and the crusher main body 28A, and expands and contracts so as to rotate the pair of crushing blades 28B and 28B in an opening and closing direction. A rotation mechanism including a hydraulic motor for rotation (not illustrated) is disposed in a distal end side portion of the link mechanism 28D. This rotation mechanism can rotate the crusher main body 28A with respect to the link mechanism 28D. Since the pair of crushing blades 28B and 28B supported by the crusher main body 28A rotates with the rotation of the crusher main body 28A, the pair of crushing blades 28B and 28B can pinch an object at a free angle.

As illustrated in FIG. 1, the first boom component 21 has a distal end portion opposite to the proximal end portion 21E. The second boom component 22 has a proximal end portion connected to the distal end portion of the first boom component 21 and a distal end portion on the opposite side. The third boom component 23 has a proximal end portion connected to the distal end portion of the second boom component 22 and a distal end portion on the opposite side. The fourth boom component 24 has a proximal end portion connected to the distal end portion of the third boom component 23. The first arm component 26 has the proximal end portion and a distal end portion on the opposite side, and the second arm component 27 has a proximal end portion connected to the distal end portion of the first arm component 26 and a distal end portion on the opposite side.

Figure 2:
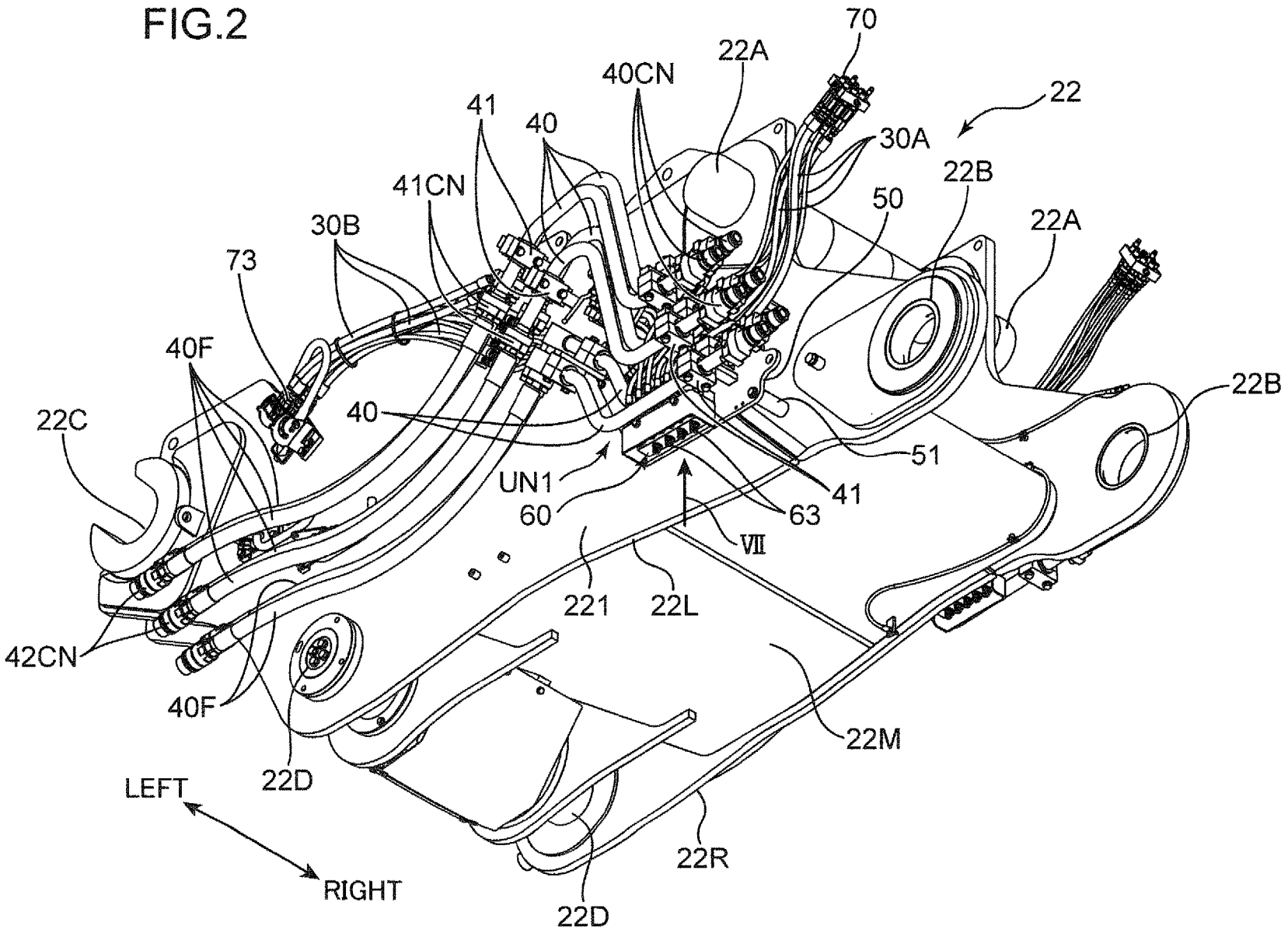
FIG. 2 is a perspective view illustrating a boom component constituting a part of a boom of a work attachment in the work machine, a plurality of high-pressure pipes, a plurality of low-pressure pipes, and a cover plate.
Figure 3:
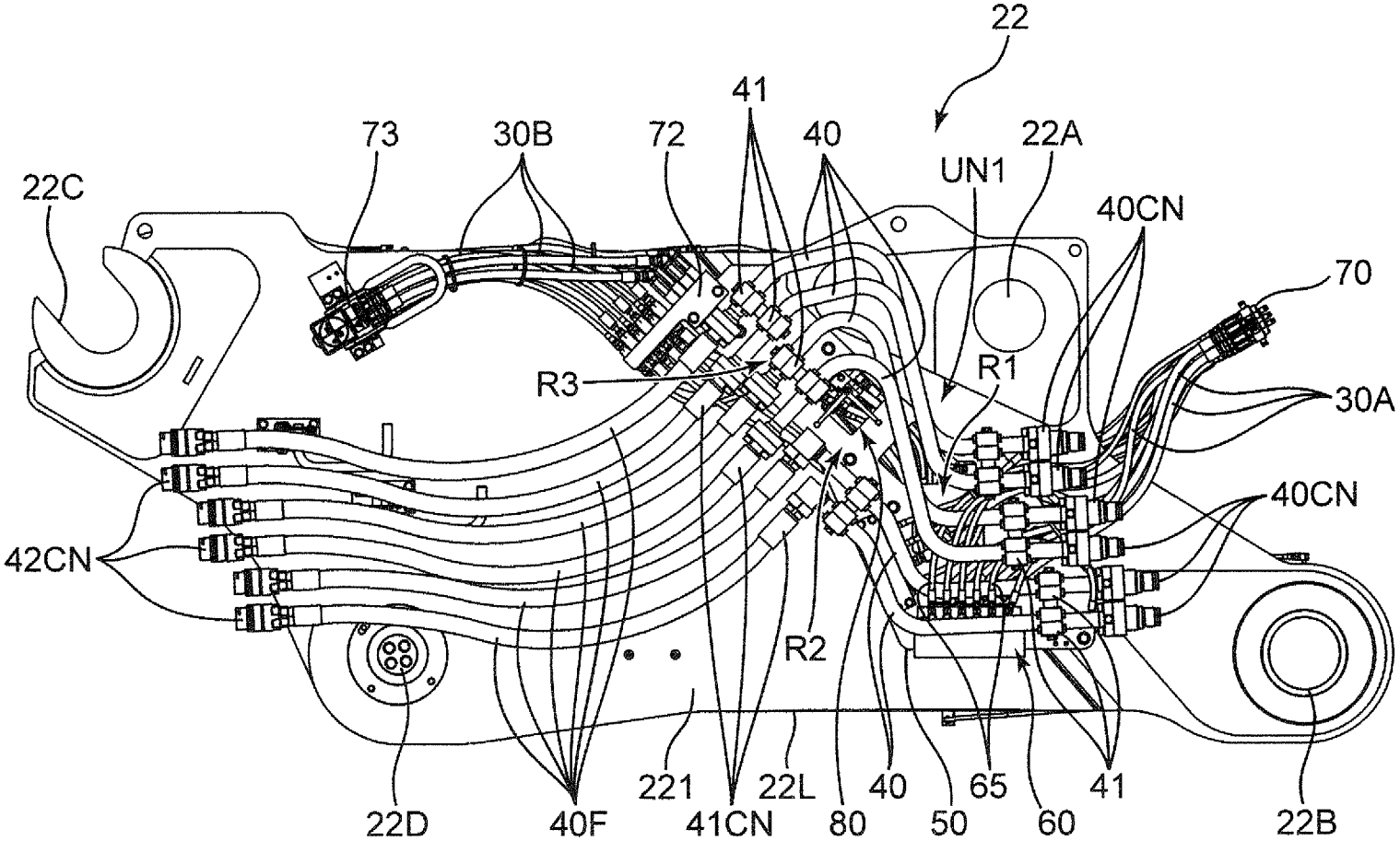
FIG. 3 is a left side view illustrating the boom component, the plurality of high-pressure pipes, the plurality of low-pressure pipes, and the cover plate.
Figure 10:
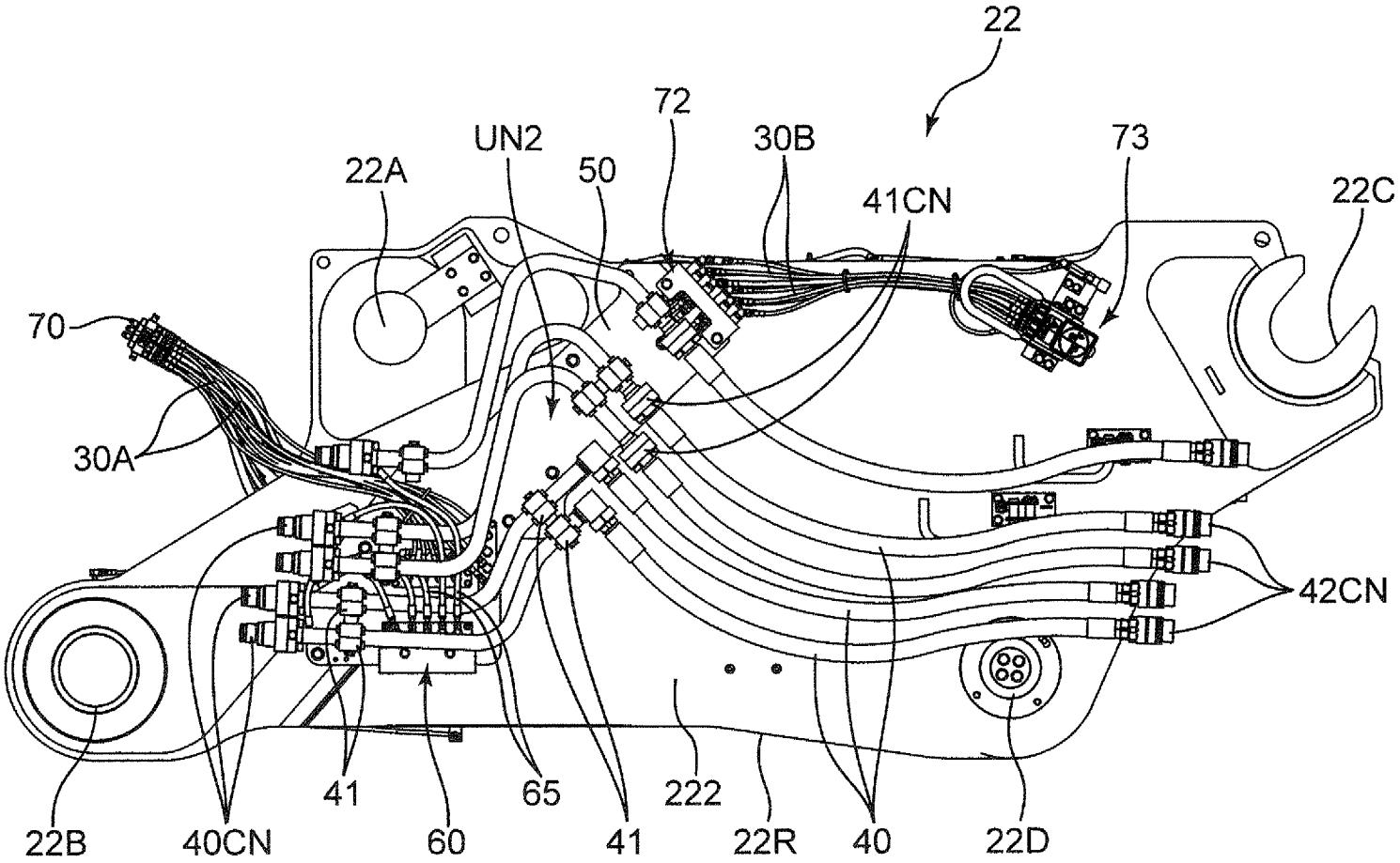
FIG. 10 is a right side view illustrating the boom component, a plurality of high-pressure pipes, a plurality of low-pressure pipes, and a cover plate.
Figure 12:
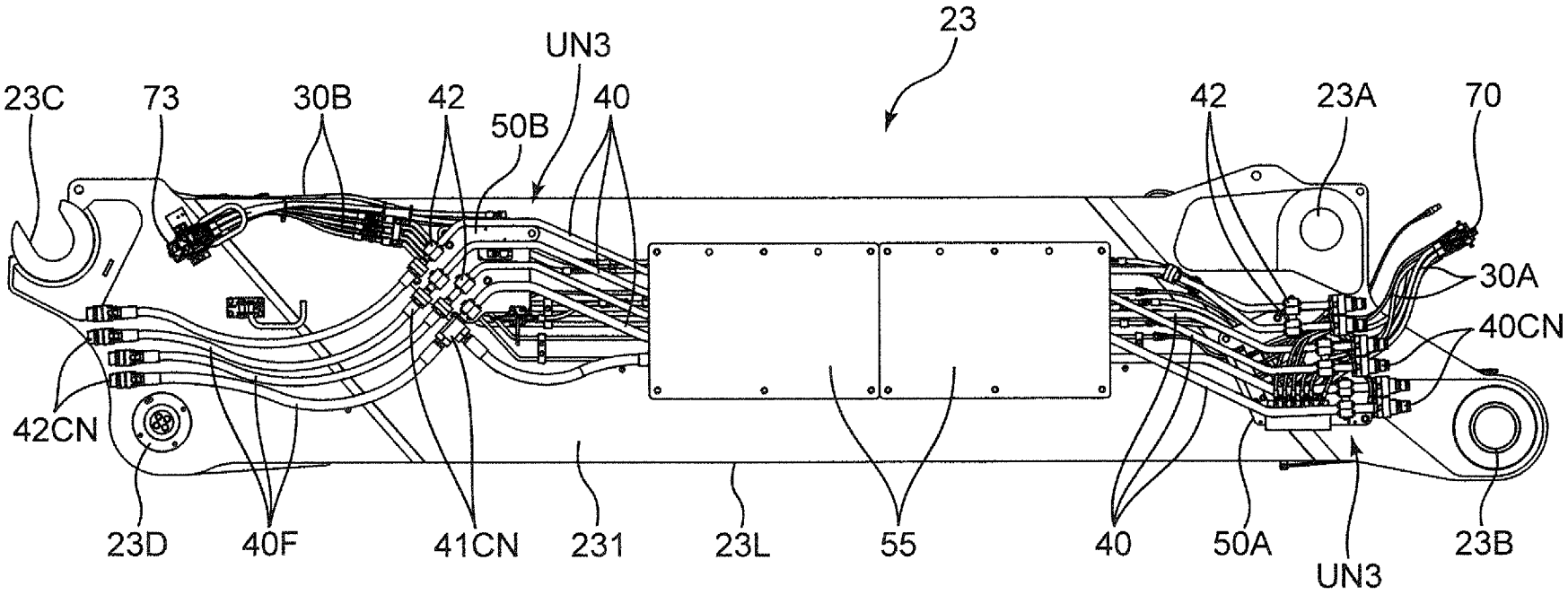
FIG. 12 is a left side view illustrating another boom component constituting a part of the boom, a plurality of high-pressure pipes, a plurality of low-pressure pipes, and two cover plates.

FIG. 2 is a perspective view illustrating the second boom component 22 and various components supported by the second boom component 22, and FIG. 3 is a left side view thereof. FIG. 10 is a right side view illustrating the second boom component 22 and various components supported by the second boom component 22. FIG. 12 is a left side view illustrating the third boom component 23 and various components supported by the third boom component 23.

As illustrated in FIG. 2, FIG. 3, and FIG. 10, the second boom component 22 includes a left side plate 22L including a left side surface 221 of the second boom component 22, a right side plate 22R including a right side surface 222 of the second boom component 22, and an intermediate portion 22M interposed between the left side plate 22L and the right side plate 22R. The left side plate 22L is a plate-shaped member that is fixed to a left side portion of the intermediate portion 22M and extends from the proximal end portion to the distal end portion of the second boom component 22. The right side plate 22R is a plate-shaped member that is fixed to a right side portion of the intermediate portion 22M and extends from the proximal end portion to the distal end portion of the second boom component 22.

As illustrated in FIG. 12, although the third boom component 23 is different from the second boom component 22 in terms of a specific shape, it is similar to the second boom component 22 in terms of a basic structure. Specifically, the third boom component 23 includes a left side plate 23L including a left side surface 231 of the third boom component 23, a right side plate including a right side surface (not illustrated) of the third boom component 23, and an intermediate portion (not illustrated) interposed between the left side plate 23L and the right side plate. The left side plate 23L is a plate-shaped member that is fixed to a left side portion of the intermediate portion and extends from the proximal end portion to the distal end portion of the third boom component 23. The right side plate of the third boom component 23 is a plate-shaped member that is fixed to a right side portion of the intermediate portion and extends from the proximal end portion to the distal end portion of the third boom component 23.

As illustrated in FIG. 2, the proximal end portion of the second boom component 22 has proximal end side connection portions 22A and 22B, and the distal end portion of the second boom component 22 has distal end side connection portions 22C and 22D. As illustrated in FIG. 12, the proximal end portion of the third boom component 23 has proximal end side connection portions 23A and 23B, and the distal end portion of the third boom component 23 has distal end side connection portions 23C and 23D. The distal end side connection portions 22C and 22D of the second boom component 22 and the proximal end side connection portions 23A and 23B of the third boom component 23 have structures detachably connectable to each other.

As illustrated in FIG. 2, FIG. 3, and FIG. 10, the proximal end side connection portion 22A of the second boom component 22 includes a pair of left and right projections projecting outward from the left side plate 22L and the right side plate 22R, respectively, and the proximal end side connection portion 22B of the second boom component 22 includes a pair of left and right through holes formed in the left side plate 22L and the right side plate 22R, respectively. The pair of through holes penetrate the left side plate 22L and the right side plate 22R in a thickness direction, respectively. The proximal end side connection portion 22A and the proximal end side connection portion 22B are disposed at intervals in a vertical direction. The distal end side connection portion 22C of the second boom component 22 includes a pair of left and right recesses, and the distal end side connection portion 22D of the second boom component 22 includes a pair of left and right through holes formed in the left side plate 22L and the right side plate 22R, respectively, and connection pins inserted into these through holes and extending in the left-right direction. The pair of through holes penetrate the left side plate 22L and the right side plate 22R in a thickness direction, respectively. The distal end side connection portion 22C and the distal end side connection portion 22D are disposed at intervals in the vertical direction. As illustrated in FIG. 3, in a state in which the second boom component 22 is disposed such that a longitudinal direction of the second boom component 22 is oriented horizontally, each of the pair of recesses has an opening in an upper portion or in an obliquely upper portion of the distal end side connection portion 22C.

The proximal end side connection portions 23A and 23B and the distal end side connection portions 23C and 23D of the third boom component 23 have the same structure as the proximal end side connection portions 22A and 22B and the distal end side connection portions 22C and 22D of the second boom component 22, respectively. Specifically, as illustrated in FIG. 12, the proximal end side connection portion 23A of the third boom component 23 includes a pair of left and right projections projecting outward from the left side plate 23L and the right side plate of the third boom component 23, respectively, and the proximal end side connection portion 23B of the third boom component 23 includes a pair of left and right through holes formed in the left side plate 23L and the right side plate of the third boom component 23, respectively. The pair of through holes penetrate the left side plate 23L and the right side plate of the third boom component 23 in a thickness direction. The proximal end side connection portion 23A and the proximal end side connection portion 23B are disposed at intervals in the vertical direction. The distal end side connection portion 23C of the third boom component 23 includes a pair of left and right recesses, and the distal end side connection portion 23D of the third boom component 23 includes a pair of left and right through holes formed in the left side plate 23L and the right side plate of the third boom component 23, respectively, and connection pins inserted into these through holes and extending in the left-right direction. The distal end side connection portion 23C and the distal end side connection portion 23D are disposed at intervals in the vertical direction. As illustrated in FIG. 12, in a state in which the third boom component 23 is disposed such that a longitudinal direction of the third boom component 23 is oriented horizontally, each of the pair of recesses has an opening in an upper portion or an obliquely upper portion of the distal end side connection portion 23C.

The distal end side connection portions 22C and 22D of the second boom component 22 and the proximal end side connection portions 23A and 23B of the third boom component 23 are connected in the following manner. First, the pair of left and right projections of the proximal end side connection portion 23A of the third boom component 23 is fitted into the pair of left and right recesses of the distal end side connection portion 22C of the second boom component 22. Next, the third boom component 23 is rotated with respect to the second boom component 2 about center axes of these projections to dispose the pair of left and right through holes of the proximal end side connection portion 23B of the third boom component 23 at positions corresponding to the pair of left and right through holes of the distal end side connection portion 22D of the second boom component 22. Next, the connection pins of the distal end side connection portion 22D are inserted into the pair of through holes of the distal end side connection portion 22D and the pair of through holes of the proximal end side connection portion 23B. Thus, the distal end side connection portions 22C and 22D of the second boom component 22 and the proximal end side connection portions 23A and 23B of the third boom component 23 are detachably connected to each other.

The distal end portion of the first boom component 21 has a distal end side connection portion (not illustrated), and the distal end side connection portion of the first boom component 21 and the proximal end side connection portions 22A and 22B of the second boom component 22 have structures detachably connectable to each other. The proximal end portion of the fourth boom component 24 has a proximal end side connection portion (not illustrated), and the distal end side connection portions 23C and 23D of the third boom component 23 and the proximal end side connection portion of the fourth boom component 24 have structures detachably connectable to each other. The distal end side connection portion of the distal end portion of the first boom component 21 has the same structure as the distal end side connection portions 22C and 22D of the second boom component 22, and the proximal end side connection portion of the fourth boom component 24 has the same structure as the proximal end side connection portions 22A and 22B of the second boom component 22.

In addition, the distal end portion of the first arm component 26 has a distal end side connection portion (not illustrated), and the proximal end portion of the second arm component 27 has a proximal end side connection portion (not illustrated). The distal end side connection portion of the first arm component 26 and the proximal end side connection portion of the second arm component 27 have structures detachably connectable to each other. The distal end side connection portion of the first arm component 26 has the same structure as the distal end side connection portions 22C and 22D of the second boom component 2, and the proximal end side connection portion of the second arm component 27 has the same structure as the proximal end side connection portions 22A and 22B of the second boom component 22.

The work attachment 20 further includes a plurality of hydraulic cylinders for changing an attitude of the work attachment 20. Upon receiving supply of a hydraulic oil from the base machine 10, the plurality of hydraulic cylinders expand or contract to change an angle between the constituent members of the work attachment 20, thereby changing the attitude of the whole work attachment 20.

Specifically, the plurality of hydraulic cylinders include a boom cylinder C1, a coupling member cylinder C2, an arm cylinder C3, and a work device cylinder C4. These cylinders C1, C2, C3, and C4 are simply indicated by dot chain lines in FIG. 1.

The boom cylinder C1 is interposed between the base machine 10 and the boom 20A so as to raise and lower the boom 20A with respect to the base machine 10 by expansion and contraction of the boom cylinder C1. Specifically, the boom cylinder C1 has a cylinder proximal end portion and a cylinder distal end portion on the opposite side. The cylinder proximal end portion is coupled to the base machine 10 via a cylinder pin so as to be rotatable about an axis parallel to the boom rotation axis, and the cylinder distal end portion is coupled to the boom 20A (in the present embodiment, the first boom component 21) via a cylinder pin so as to be rotatable about an axis parallel to the boom rotation axis. The boom cylinder C1 has a head side chamber and a rod side chamber.

The coupling member cylinder C2 is interposed between the boom 20A and the coupling member 25 so as to rotate the coupling member 25 with respect to the boom 20A by the expansion and contraction of the coupling member cylinder C2. Specifically, the coupling member cylinder C2 has a cylinder proximal end portion and a cylinder distal end portion on the opposite side. The cylinder proximal end portion is coupled to the boom 20A (in the present embodiment, the fourth boom component 24) via a cylinder pin so as to be rotatable about an axis parallel to the coupling member rotation axis, and the cylinder distal end portion is coupled to the coupling member 25 via a cylinder pin so as to be rotatable about an axis parallel to the coupling member rotation axis. The coupling member cylinder C2 has a head side chamber and a rod side chamber.

The arm cylinder C3 is interposed between the coupling member 25 and the arm 20B so as to rotate the arm 20B with respect to the coupling member 25 by the expansion and contraction of the arm cylinder C3. Specifically, the arm cylinder C3 has a cylinder proximal end portion and a cylinder distal end portion on the opposite side. The cylinder proximal end portion is coupled to the coupling member 25 via a cylinder pin so as to be rotatable about an axis parallel to the arm rotation axis, and the cylinder distal end portion is coupled to the arm 20B (in the present embodiment, the first arm component 26) via a cylinder pin so as to be rotatable about an axis parallel to the arm rotation axis. The arm cylinder C3 has a head side chamber and a rod side chamber.

The work device cylinder C4 is interposed between the arm 20B and the distal end work device 28 so as to rotate the distal end work device 28 with respect to the arm 20B by the expansion and contraction of the work device cylinder C4. Specifically, the work device cylinder C4 has a cylinder proximal end portion and a cylinder distal end portion on the opposite side. The cylinder proximal end portion is coupled to the arm 20B (in the present embodiment, the second arm component 27) via a cylinder pin so as to be rotatable about an axis parallel to the work device rotation axis, and the cylinder distal end portion is coupled to the distal end work device 28 (in the present embodiment, the link mechanism 28D) via a cylinder pin so as to be rotatable about an axis parallel to the work device rotation axis. The work device cylinder C4 has a head side chamber and a rod side chamber.

The work machine 100 further includes a plurality of high-pressure piping circuits and a plurality of low-pressure piping circuits.

The plurality of high-pressure piping circuits include four high-pressure piping circuits PC1 to PC4 for supplying a hydraulic oil discharged from the hydraulic pump 12E disposed in the machine room 12C of the upper slewing body 12 to the boom cylinder C1, the coupling member cylinder C2, the arm cylinder C3, and the work device cylinder C4, respectively. Each of the four high-pressure piping circuits PC1 to PC4 is simply indicated by a two-dot chain line in FIG. 1. The four high-pressure piping circuits PC1 to PC4 are a first high-pressure piping circuit PC1 (boom cylinder high-pressure piping circuit), a second high-pressure piping circuit PC2 (coupling member cylinder high-pressure piping circuit), a third high-pressure piping circuit PC3 (arm cylinder high-pressure piping circuit), and a fourth high-pressure piping circuit PC4 (work device cylinder high-pressure piping circuit). Each of the second high-pressure piping circuit PC2, the third high-pressure piping circuit PC3, and the fourth high-pressure piping circuit PC4 is disposed so as to extend along a left side surface or a right side surface of the work attachment 20.

Each of the four high-pressure piping circuits PC1 to PC4 includes an upstream circuit and a downstream circuit. Specifically, the upstream circuit of the first high-pressure piping circuit PC1 connects the hydraulic pump 12E and one of the head side chamber and the rod side chamber of the boom cylinder C1, and the downstream circuit of the first high-pressure piping circuit PC1 connects the other of the head side chamber and the rod side chamber of the boom cylinder C1 and the tank 12G. The upstream circuit of the second high-pressure piping circuit PC2 connects the hydraulic pump 12E and one of the head side chamber and the rod side chamber of the coupling member cylinder C2, and the downstream circuit of the second high-pressure piping circuit PC2 connects the other of the head side chamber and the rod side chamber of the coupling member cylinder C2 and the tank 12G. The upstream circuit of the third high-pressure piping circuit PC3 connects the hydraulic pump 12E and one of the head side chamber and the rod side chamber of the arm cylinder C3, and the downstream circuit of the third high-pressure piping circuit PC3 connects the other of the head side chamber and the rod side chamber of the arm cylinder C3 and the tank 12G. The upstream circuit of the fourth high-pressure piping circuit PC4 connects the hydraulic pump 12E and one of the head side chamber and the rod side chamber of the work device cylinder C4, and the downstream circuit of the fourth high-pressure piping circuit PC4 connects the other of the head side chamber and the rod side chamber of the work device cylinder C4 and the tank 12G.

The control valve unit 12F prevents the hydraulic oil discharged from the hydraulic pump 12E from being supplied to the cylinders C1 to C4 when operation is not given to any of the pair of operation levers. When operation is given to at least one of the pair of operation levers, the control valve unit 12F operates to allow the hydraulic oil discharged from the hydraulic pump 12E to be supplied to either the head side chamber or the rod side chamber of the hydraulic cylinder corresponding to the operation among the cylinders C1 to C4, and allow the hydraulic oil discharged from the other of the head side chamber and the rod side chamber to return to the tank 12G.

The boom cylinder C1 has the cylinder proximal end portion coupled to the base machine 10, and is disposed at a position relatively close to the hydraulic pump 12E. Therefore, the first high-pressure piping circuit PC1 connected to the boom cylinder C1 is disposed in the vicinity of the upper slewing body 12. By contrast, the coupling member cylinder C2, the arm cylinder C3, and the work device cylinder C4 are disposed at positions far from the upper slewing body 12 as illustrated in FIG. 1. Therefore, the second high-pressure piping circuit PC2 connected to the coupling member cylinder C2, the third high-pressure piping circuit PC3 connected to the arm cylinder C3, and the fourth high-pressure piping circuit PC4 connected to the work device cylinder C4 are disposed to extend along the work attachment 20 as illustrated in FIG. 1.

Specifically, the upstream circuit of the second high-pressure piping circuit PC2 extends from the hydraulic pump 12E to the proximal end portion of the boom 20A, and extends from the proximal end portion to the coupling member cylinder C2 along either a left side surface or a right side surface of the boom 20A. The downstream circuit of the second high-pressure piping circuit PC2 extends from the coupling member cylinder C2 to the proximal end portion of the boom 20A along either the left side surface or the right side surface of the boom 20A, and extends from the proximal end portion to the tank 12G.

The upstream circuit of the third high-pressure piping circuit PC3 extends from the hydraulic pump 12E to the proximal end portion of the boom 20A, extends from the proximal end portion to the distal end portion of the boom 20A along either the left side surface or the right side surface of the boom 20A, and extends from the distal end portion to the arm cylinder C3 along either a left side surface or a right side surface of the coupling member 25. The downstream circuit of the third high-pressure piping circuit PC3 extends from the arm cylinder C3 to the distal end portion of the boom 20A along either the left side surface or the right side surface of the coupling member 25, extends from the distal end portion to the proximal end portion of the boom 20A along either the left side surface or the right side surface of the boom 20A, and extends from the proximal end portion to the tank 12G.

The upstream circuit of the fourth high-pressure piping circuit PC4 extends from the hydraulic pump 12E to the proximal end portion of the boom 20A, extends from the proximal end portion to the distal end portion of the boom 20A along either the left side surface or the right side surface of the boom 20A, extends from the distal end portion of the boom 20A to the distal end portion of the coupling member 25 along either the left side surface or the right side surface of the coupling member 25, and extends from the distal end portion to the work device cylinder C4 along either a left side surface or a right side surface of the arm 20B. The downstream circuit of the fourth high-pressure piping circuit PC4 extends from the work device cylinder C4 to the distal end portion of the coupling member 25 along either the left side surface or the right side surface of the arm 20B, extends from the distal end portion of the coupling member 25 to the distal end portion of the boom 20A along either the left side surface or the right side surface of the coupling member 25, extends from the distal end portion to the proximal end portion of the boom 20A along either the left side surface or the right side surface of the boom 20A, and extends from the proximal end portion to the tank 12G.

The plurality of low-pressure piping circuits include a low-pressure piping circuit for supplying hydraulic oil to a quick hitch, a low-pressure piping circuit for supplying hydraulic oil to a pin insertion and removal device, a low-pressure piping circuit for supplying hydraulic oil to the pair of crushing cylinders 28C and 28C, a low-pressure piping circuit for supplying hydraulic oil to the hydraulic motor for rotation for rotating the crusher main body 28A with respect to the link mechanism 28D, and the like. The quick hitch is, for example, a mechanism component attached to the distal end portion of the arm 20B, and is a device for automatically coupling the distal end work device 28 such as a crusher, a bucket, a lifting magnet, or a breaker to the distal end portion of the arm 20B. The pin insertion and removal device is a device for inserting and removing the connection pin for connecting two adjacent components among a plurality of components constituting the work attachment 20. Among the plurality of low-pressure piping circuits, one that needs to send the hydraulic oil to a portion of the work attachment 20 relatively far away from the upper slewing body 12 is disposed to extend along the work attachment 20. Although the plurality of low-pressure piping circuits are not illustrated in FIG. 1, the plurality of low-pressure piping circuits are disposed to extend along the left side surface or the right side surface of the work attachment 20 like the high-pressure piping circuits PC2 to PC4 in FIG. 1.

Since the work machine 100 according to the present embodiment is such a demolition machine as illustrated in FIG. 1, and the work attachment 20 has a large dimension in a longitudinal direction, the work attachment 20 is transported while divided into a plurality of portions. Therefore, each of the second high-pressure piping circuit PC2, the third high-pressure piping circuit PC3, and the fourth high-pressure piping circuit PC4 is formed by coupling a plurality of high-pressure pipes in series so as to be detachable from each other via a plurality of connectors. Similarly, among the plurality of low-pressure piping circuits, each of the low-pressure piping circuits disposed to extend along the work attachment 20 is formed by coupling a plurality of low-pressure pipes in series so as to be detachable from each other via a plurality of connectors.

Each of the plurality of low-pressure pipes has a hydraulic oil of a pressure (maximum pressure) lower than the high-pressure pipe, and thus has a smaller outer diameter and lower strength than the high-pressure pipe. Therefore, the work machine 100 according to the present embodiment includes a plurality of pipe protection units having a pipe protection structure for protecting at least a part of the plurality of low-pressure pipes. In the following, the pipe protection unit according to the present embodiment will be specifically described.

The plurality of pipe protection units include a pipe protection unit UN1 disposed on the left side surface 221 of the second boom component 22 as illustrated in FIG. 2 and FIG. 3, a pipe protection unit UN2 disposed on the right side surface 222 of the second boom component 22 as illustrated in FIG. 10, and a pipe protection unit UN3 disposed on the left side surface 231 of the third boom component 23 as illustrated in FIG. 12. Each of the left side surface 221, the right side surface 222, and the left side surface 231 is an example of an attachment side surface.

Although not illustrated, the plurality of pipe protection units may include at least one of a pipe protection unit disposed on a left side surface of the first boom component 21, a pipe protection unit disposed on a right side surface of the first boom component 21, a pipe protection unit disposed on a right side surface of the third boom component 23, a pipe protection unit disposed on a left side surface of the fourth boom component 24, and a pipe protection unit disposed on a right side surface of the fourth boom component 24. The plurality of pipe protection units may include at least one of a pipe protection unit disposed on a left side surface of the first arm component 26, a pipe protection unit disposed on a right side surface of the first arm component 26, a pipe protection unit disposed on a left side surface of the second arm component 27, and a pipe protection unit disposed on a right side surface of the second arm component 27.

Figure 5:
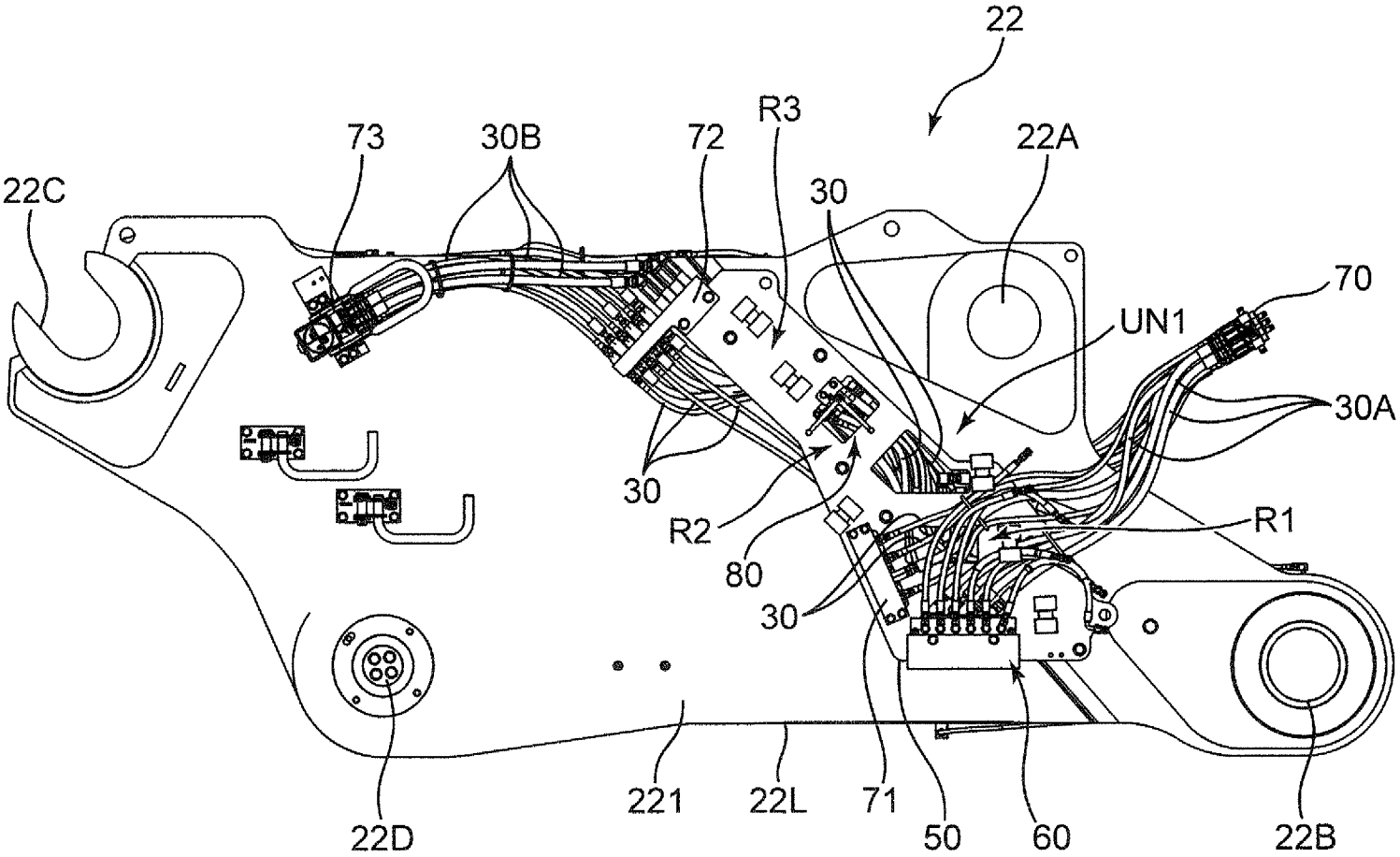
FIG. 5 is a left side view illustrating the boom component, the plurality of low-pressure pipes, and the cover plate.

In the present embodiment, the plurality of pipe protection units have similar basic structures. Specifically, each of the plurality of pipe protection units includes a plurality of low-pressure pipes, a plurality of high-pressure pipes, and a cover plate 50 (pipe fixing plate). The plurality of low-pressure pipes include, for example, a plurality of inner low-pressure pipes 30 as shown in FIG. 5, and the plurality of high-pressure pipes include, for example, a plurality of outer high-pressure pipes 40 as shown in FIG. 2. The plurality of inner low-pressure pipes 30 are hydraulic pipes disposed along the attachment side surface. The plurality of outer high-pressure pipes 40 are hydraulic pipes disposed along the attachment side surface at an outer position than the plurality of inner low-pressure pipes 30. The plurality of outer high-pressure pipes 40 have an outer diameter larger than that of the plurality of inner low-pressure pipes 30. The cover plate 50 is a plate that is disposed along the attachment side surface so as to be interposed between the plurality of inner low-pressure pipes 30 and the plurality of outer high-pressure pipes 40 and is supported by the work attachment 20. The cover plate 50 covers at least a part of each of the plurality of inner low-pressure pipes 30. Since each of the plurality of pipe protection units has the basic structure as described above, the pipe protection unit UN1 disposed on the left side surface 221 of the second boom component 22 will be mainly described in detail below.

FIG. 2 to FIG. 9 are views related to the pipe protection unit UN1 disposed on the left side surface 221 of the second boom component 22. As illustrated in FIG. 2 to FIG. 5, the pipe protection unit UN1 includes the plurality of inner low-pressure pipes 30, a plurality of outer low-pressure pipes 30A, a plurality of outer low-pressure pipes 30B, the plurality of outer high-pressure pipes 40, a plurality of flexible high-pressure pipes 40F, and a plurality of connectors. The plurality of connectors include a plurality of high-pressure pipe connectors 40CN, 41CN, and 42CN, a pressure release connector 60, and a plurality of low-pressure pipe connectors 70 to 73.

Figure 4:
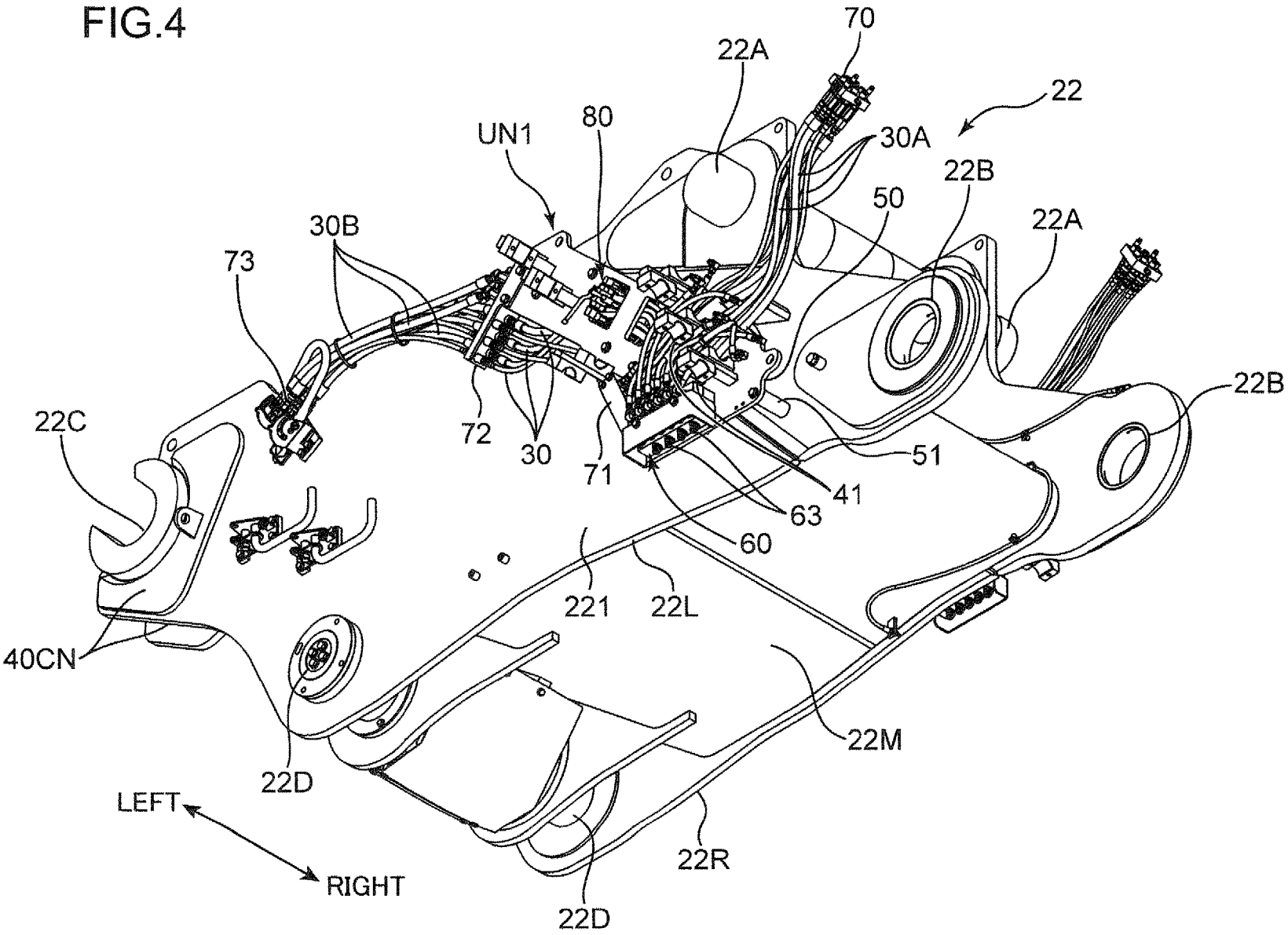
FIG. 4 is a perspective view illustrating the boom component, the plurality of low-pressure pipes, and the cover plate.
Figure 6:
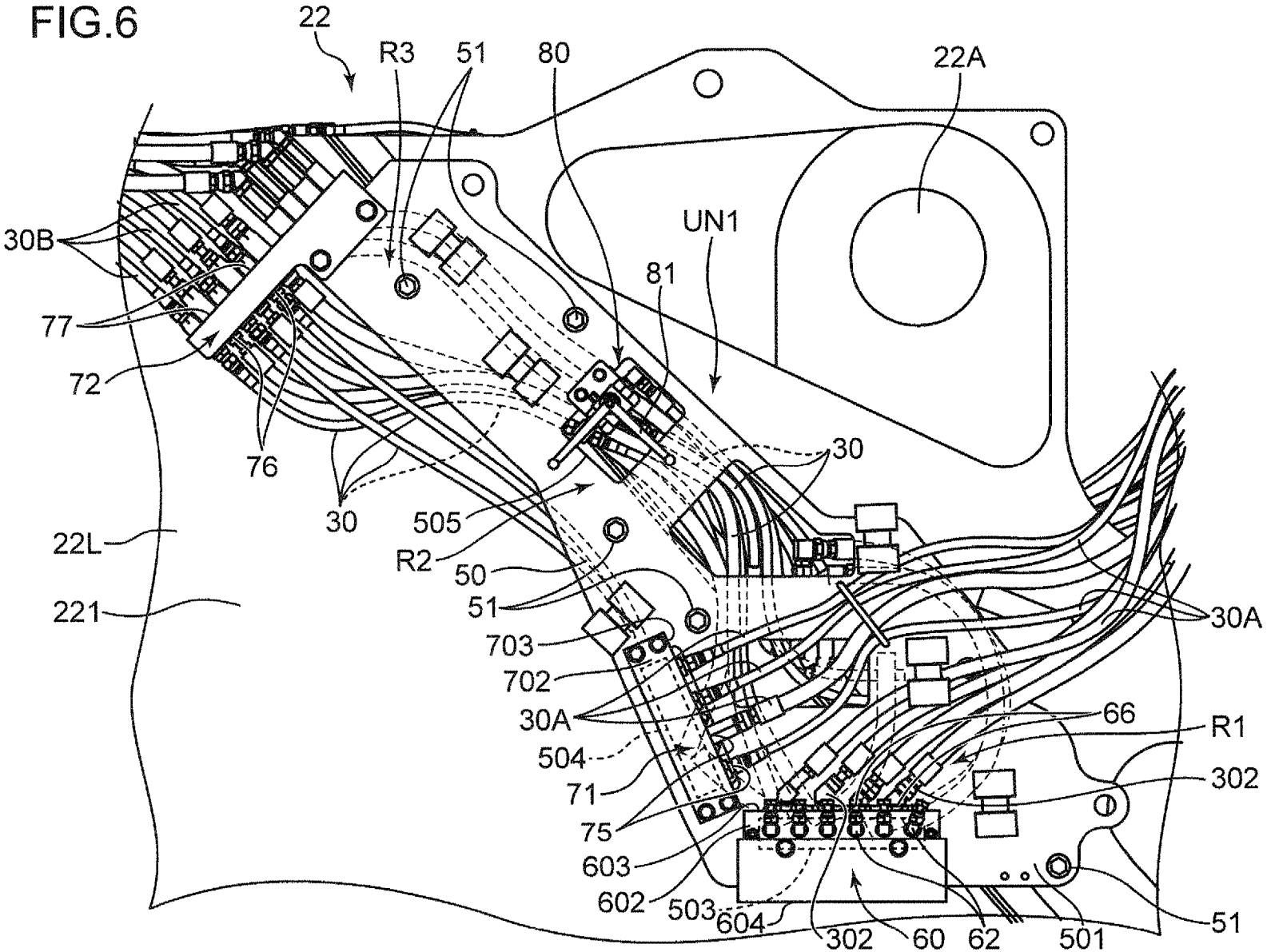
FIG. 6 is an enlarged view of a part of FIG. 5.
Figure 7:
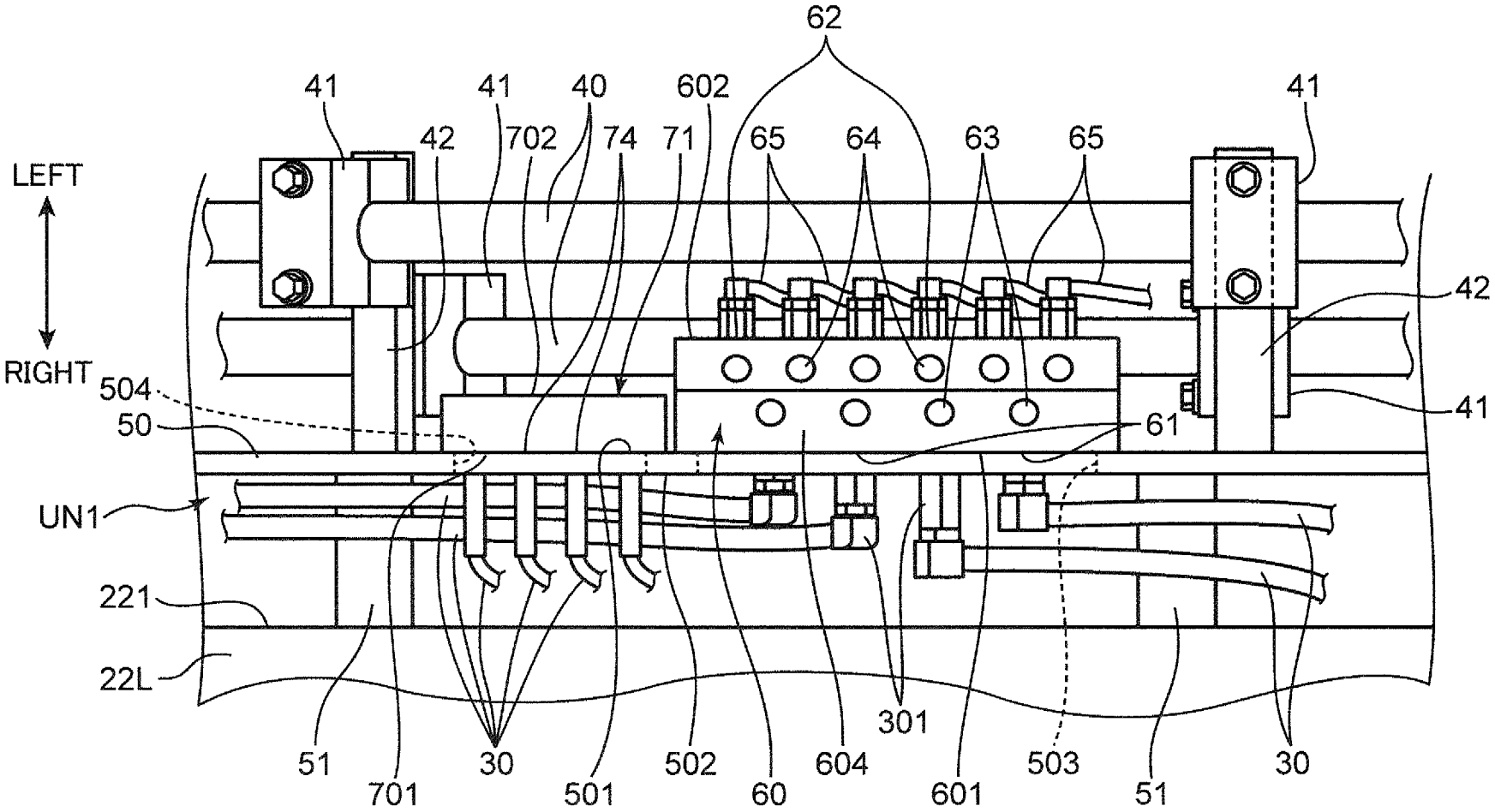
FIG. 7 is a view of a left side plate of the boom component, the plurality of low-pressure pipes, the cover plate, the plurality of high-pressure pipes, and a pressure release connector as viewed in a direction of arrow VII in FIG. 2.
Figure 8:
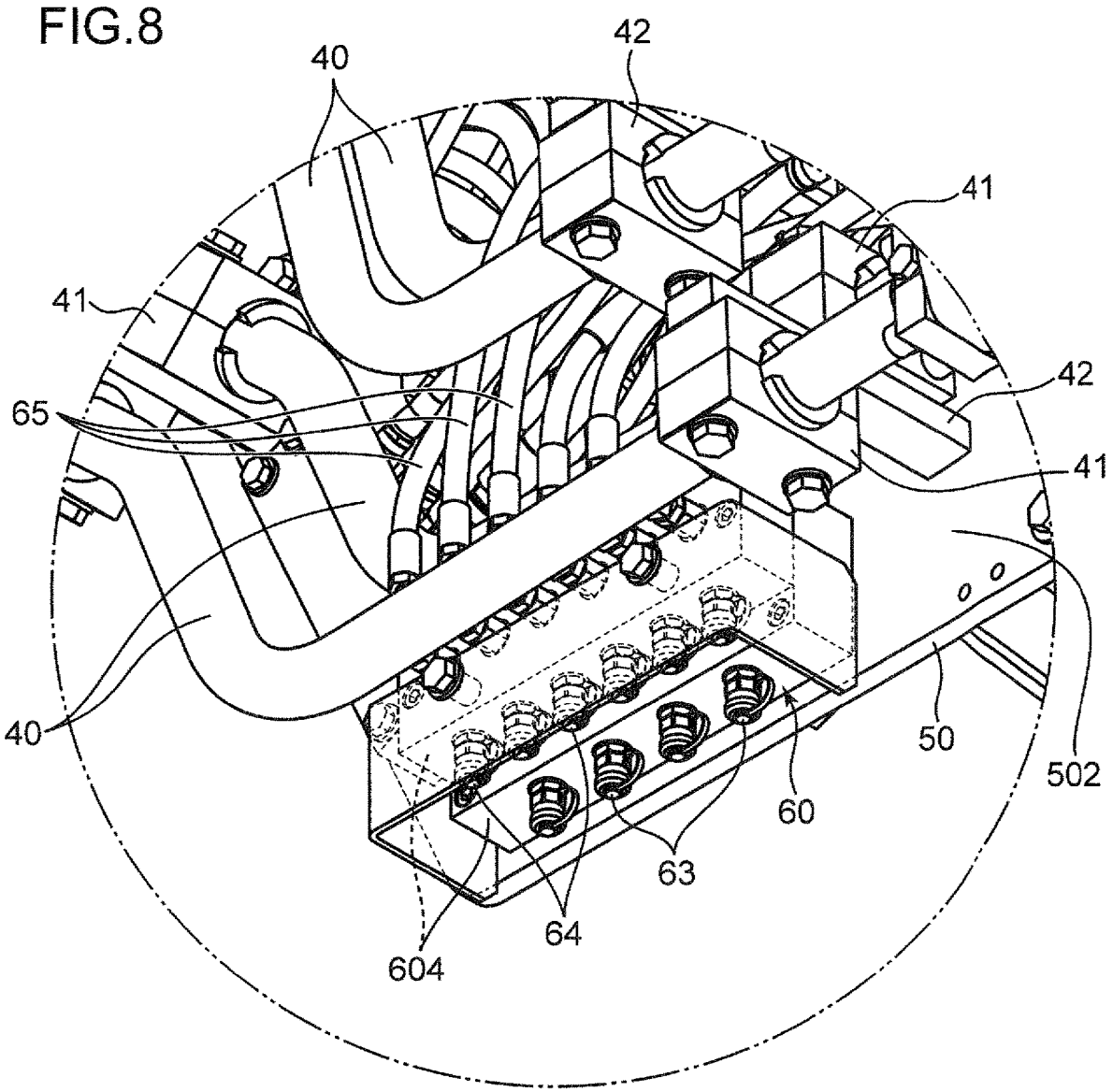
FIG. 8 is a perspective view illustrating the pressure release connector and its surroundings.
Figure 9:
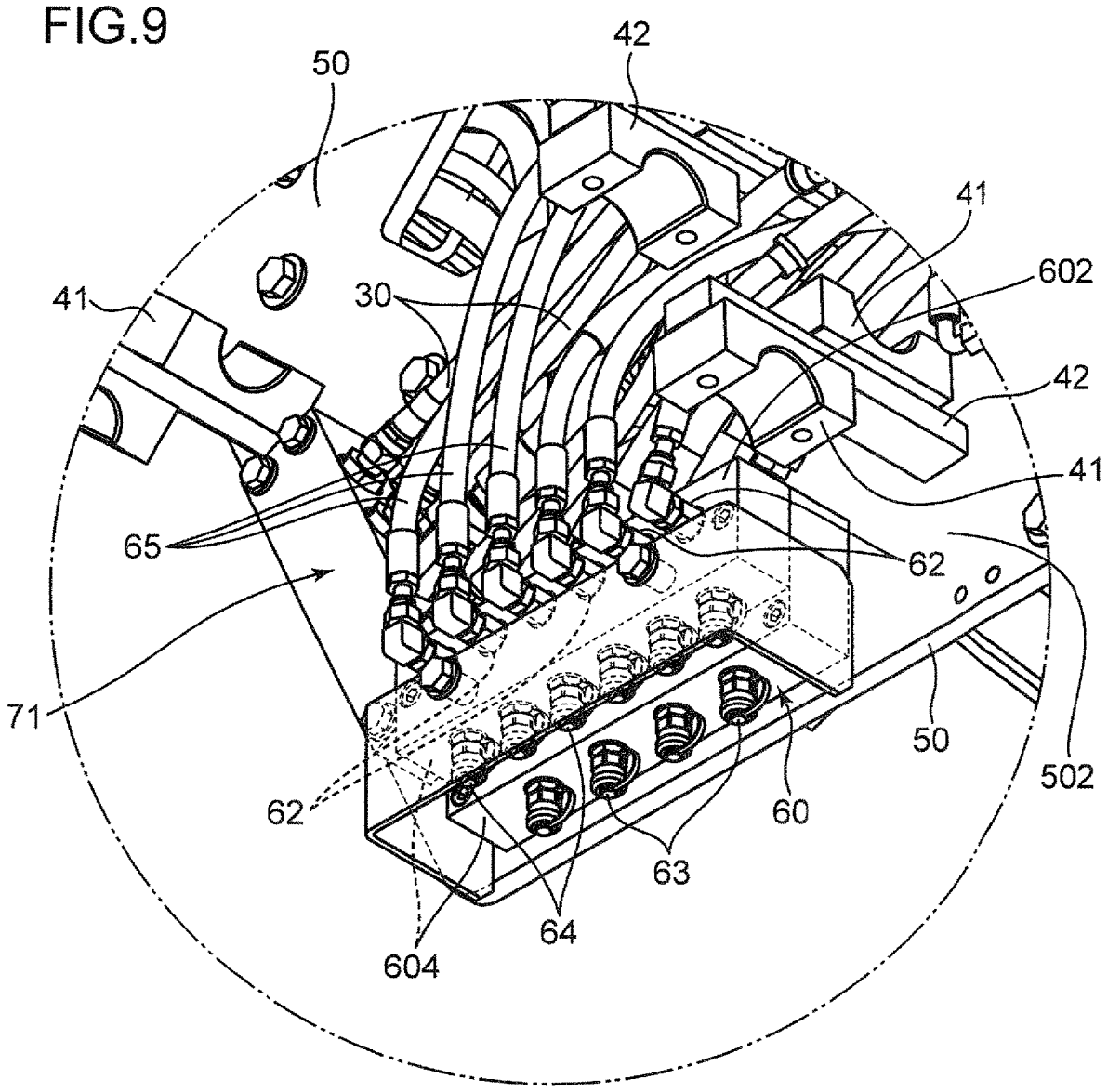
FIG. 9 is a perspective view illustrating the pressure release connector and its surroundings.

FIG. 2 to FIG. 9 will be briefly described as follows. In the perspective view of FIG. 2 and the left side view of FIG. 3, the second boom component 22, the plurality of high-pressure pipes 40 and 40F, the plurality of low-pressure pipes 30, 30A, and 30B, the cover plate 50, and the plurality of connectors arc illustrated. On the other hand, FIG. 4 is a perspective view in which illustration of the plurality of high-pressure pipes 40 and 40F in FIG. 2 is omitted, and FIG. 5 is a left side view in which illustration of the plurality of high-pressure pipes 40 and 40F in FIG. 3 is omitted. FIG. 6 is an enlarged view of a part of FIG. 5. FIG. 7 is a view of the left side plate 22L of the second boom component 22, the plurality of inner low-pressure pipes 30, the cover plate 50, the plurality of outer high-pressure pipes 40, and the pressure release connector 60 as viewed in a direction of arrow VII in FIG. 2. FIG. 8 and FIG. 9 are perspective views illustrating the pressure release connector 60 and its surrounding.

As illustrated in FIG. 4 to FIG. 7, in the pipe protection unit UN1, the cover plate 50 is a plate-like member disposed at an interval from the left side surface 221 of the second boom component 22 in the left-right direction. The cover plate 50 has a plate inner surface 502 which is an inner surface opposed to the left side surface 221 of the second boom component 22, and a plate outer surface 501 which is an outer surface opposite to the plate inner surface 502. In the present embodiment, the cover plate 50 has a flat plate shape substantially parallel to the left side surface 221 of the second boom component 22. It is noted that the shape of the cover plate 50 is not limited to a flat plate, and the cover plate 50 may not necessarily be disposed parallel to the left side surface 221 of the second boom component 22.

As illustrated in FIG. 7, the pipe protection unit UN1 further includes a plurality of support members 51 that support the cover plate 50. For example, as illustrated in FIG. 6, the plurality of support members 51 are disposed at positions dispersed to some extent over the entire area of the cover plate 50. Each of the plurality of support members 51 includes a support member proximal end portion that is a proximal end portion fixed to the left side surface 221 of the second boom component 22, and a support member distal end portion that is a distal end portion fixed to the cover plate 50. Although in the present embodiment, each of the support members 51 has a columnar shape extending from the support member proximal end portion to the support member distal end portion, the shape of each support member 51 is not limited to the columnar shape. Each of the plurality of support members 51 has a length large enough to dispose the plurality of inner low-pressure pipes 30 in an inner space that is a space between the left side surface 221 of the second boom component 22 and the plate inner surface 502 of the cover plate 50.

Each of the plurality of outer high-pressure pipes 40 includes a pipe proximal end portion and a pipe distal end portion, and each of the plurality of flexible high-pressure pipes 40F includes a pipe proximal end portion and a pipe distal end portion. The plurality of high-pressure pipe connectors 40CN are attached to the pipe proximal end portions of the plurality of outer high-pressure pipes 40, respectively. The plurality of high-pressure pipe connectors 42CN are attached to the pipe distal end portions of the plurality of flexible high-pressure pipes 40F, respectively. The pipe distal end portions of the plurality of outer high-pressure pipes 40 are connected to the pipe proximal end portions of the plurality of flexible high-pressure pipes 40F via the plurality of high-pressure pipe connectors 41CN, respectively.

The plurality of high-pressure pipe connectors 40CN in the pipe protection unit UN1 are detachably connected to a plurality of high-pressure pipe connectors attached to a plurality of high-pressure pipes (not illustrated) disposed along the left side surface of the first boom component 21. The plurality of high-pressure pipe connectors 42CN in the pipe protection unit UN1 are detachably connected to the plurality of high-pressure pipe connectors 40CN in the pipe protection unit UN3 disposed on the left side surface 231 of the third boom component 23 illustrated in FIG. 12.

In the specific example illustrated in FIG. 3, the pipe protection unit UN1 includes six high-pressure pipe sets, each high-pressure pipe set including one outer high-pressure pipe 40 and one flexible high-pressure pipe 40F. Each high-pressure pipe set is included in an upstream circuit or a downstream circuit of any one of the plurality of high-pressure piping circuits.

Each of the plurality of outer high-pressure pipes 40 is formed, for example, of a pipe such as a steel pipe and has pressure resistance enabling withstanding to a high pressure caused by the hydraulic oil inside thereof. Each of the plurality of outer high-pressure pipes 40 has rigidity higher than the rigidity of the flexible high-pressure pipe 40F. Each of the plurality of outer high-pressure pipes 40 is fixed to the cover plate 50. The plurality of outer high-pressure pipes 40 are disposed side by side along the cover plate 50.

The pipe protection unit UN1 further includes a fixing portion for fixing the plurality of outer high-pressure pipes 40 to the cover plate 50. The fixing portion is attached to the cover plate 50. As shown in FIG. 7 to FIG. 9, the fixing portion restrains vicinities of both end portions of each of the outer high-pressure pipes 40.

Specifically, the fixing portion includes a plurality of supports 42 extending from the cover plate 50 in an outward direction (leftward direction) opposite to the left side surface 221 of the second boom component 22, and at least one fixing member 41 supported by each support 42. In the present embodiment, two fixing members 41 are supported by one support 42. The plurality of supports 42 include a plurality of proximal end side supports 42 disposed near the pipe proximal end portions of the outer high-pressure pipes 40 and a plurality of distal end side supports 42 disposed near the pipe distal end portions of the outer high-pressure pipes 40. Each of the plurality of outer high-pressure pipes 40 is fixed to the cover plate 50 by the corresponding proximal end side support 42 and the fixing member 41 supported by the proximal end side support, and the corresponding distal end side support 42 and the fixing member 41 supported by the distal end side support. Each fixing member 41 has a structure that can be divided into two portions by removing a fastening member such as a bolt. The two portions are fixed to each other by bolts in a state of being disposed so as to surround the corresponding outer high-pressure pipe 40. As a result, the outer high-pressure pipe 40 is fixed to the cover plate 50.

Each of the plurality of flexible high-pressure pipes 40F is formed of a flexible pipe and has pressure resistance enabling withstanding to a high pressure caused by the hydraulic oil inside. The pipe proximal end portions of the plurality of flexible high-pressure pipes 40F are attached to the plurality of high-pressure pipe connectors 41CN, respectively, as described above, and thus, the positions thereof are fixed. By contrast, a portion of each of the plurality of flexible high-pressure pipes 40F excluding the pipe proximal end portion can be freely changed in position to some extent. As a result, in the assembling work and the disassembling work for the second boom component 22 and the third boom component 23, it is easy to attach and detach the plurality of high-pressure pipe connectors 42CN in the pipe protection unit UN1 and the plurality of high-pressure pipe connectors 40CN in the pipe protection unit UN3.

As illustrated in FIG. 6, the plurality of inner low-pressure pipes 30 are disposed side by side in the inner space that is a space between the cover plate 50 and the left side surface 221 of the second boom component 22. Each of the plurality of inner low-pressure pipes 30 is formed of a flexible pipe. This facilitates routing of the plurality of inner low-pressure pipes 30 in the inner space. Each of the plurality of inner low-pressure pipes 30 includes a pipe proximal end portion and a pipe distal end portion, each of the plurality of outer low-pressure pipes 30A includes a pipe proximal end portion and a pipe distal end portion, and each of the plurality of outer low-pressure pipes 30B includes a pipe proximal end portion and a pipe distal end portion. The pipe proximal end portions of the plurality of outer low-pressure pipes 30A are connected to the low-pressure pipe connector 70. The low-pressure pipe connector 70 is detachably connected to a low-pressure pipe connector (not illustrated) to which pipe distal end portions of a plurality of low-pressure pipes (not illustrated) disposed along the left side surface of the first boom component 21 are connected. The pipe distal end portions of the plurality of outer low-pressure pipes 30B are connected to the low-pressure pipe connector 73. The low-pressure pipe connector 73 is detachably connected to the low-pressure pipe connector 70 disposed on the left side surface 231 of the third boom component 23 in the pipe protection unit UN3. The low-pressure pipe connector 73 is fixed to the left side surface 221 of the second boom component 22 at a position separated from the cover plate 50.

As illustrated in FIG. 3 and FIG. 5, the cover plate 50 includes a plate proximal end region R1, a plate intermediate region R2, and a plate distal end region R3. The plate proximal end region R1 is a region including a portion corresponding to the pipe proximal end portions of the plurality of outer high-pressure pipes 40. The plate distal end region R3 is a region including a portion corresponding to the pipe distal end portions of the plurality of outer high-pressure pipes 40. The plate intermediate region R2 is a region located between the plate proximal end region R1 and the plate distal end region R3 and connecting the regions. As shown in FIG. 3 and FIG. 5, in a state in which the second boom component 22 is disposed to have an attitude in which a longitudinal direction of the second boom component 22 is oriented in a substantially horizontal direction (fallen attitude), in other words, for example, in a state in which the work attachment 20 is disposed to have an attitude of being fallen in the substantially horizontal direction (fallen attitude), the plate distal end region R3 is located closer to the distal end portion (left end portion in FIG. 3 and FIG. 5) of the second boom component 22 than the plate proximal end region R1. In the present embodiment, the cover plate 50 has a shape extending obliquely upward (upward and forward) from the plate proximal end region R1 toward the plate distal end region R3 in a state where the work attachment 20 is disposed to have the fallen attitude. It is noted that the shape of the cover plate 50 is not limited to the shape illustrated in FIG. 3.

The pressure release connector 60 is a connector enabling the pressure inside the pipe connected to the pressure release connector 60 to be released. The pressure release connector 60 is supported by the cover plate 50. The pressure release connector 60 is a connector enabling a part of the plurality of inner low-pressure pipes 30 and a part of the plurality of outer low-pressure pipes 30A to be coupled.

As illustrated in FIG. 6 and FIG. 7, the pressure release connector 60 includes a first side surface 601 which is an inner surface (right side surface in the present embodiment) opposed to the plate outer surface 501 of the cover plate 50, a second side surface 602 which is an outer surface (left side surface in the present embodiment) opposite to the first side surface 601, a third side surface 603 connecting the first side surface 601 and the second side surface 602, and a fourth side surface 604 connecting the first side surface 601 and the second side surface 602 on a side opposite to the third side surface 603. In the present embodiment, as illustrated in FIG. 3 and FIG. 6, in a state in which the second boom component 22 is disposed to have the fallen attitude, the third side surface 603 becomes an upper surface of the pressure release connector 60, and the fourth side surface 604 becomes a lower surface of the pressure release connector 60.

The pressure release connector 60 is fixed to the cover plate 50 in a state where the first side surface 601 is in contact with the plate outer surface 501. Therefore, the pressure release connector 60 is disposed at an outer position (in the leftward direction) than the cover plate 50. In other words, the pressure release connector 60 is disposed on the side opposite to the plurality of inner low-pressure pipes 30 with respect to the cover plate 50.

The pressure release connector 60 includes a plurality of first connection ports 61, a plurality of second connection ports 62, a plurality of third connection ports 66, and a plurality of pressure release connection ports 63 and 64. Each of the plurality of pressure release connection ports 63 is an example of a low-pressure pipe pressure release port, and each of the plurality of pressure release connection ports 64 is an example of a high-pressure pipe pressure release port. Each of the plurality of first connection ports 61 is an example of an inner connection port.

The plurality of first connection ports 61 are formed on the first side surface 601 (inner surface) of the pressure release connector 60. The pipe proximal end portions (as an example of the inner end portion) of a part of the inner low-pressure pipes 30 among the plurality of inner low-pressure pipes 30 are connected to the plurality of first connection ports 61, respectively. As illustrated in FIG. 6 and FIG. 7, a through hole 503 is formed in a portion of the cover plate 50 corresponding to the plurality of first connection ports 61. As a result, the plurality of first connection ports 61 are exposed to the space between the cover plate 50 and the left side surface 221 of the second boom component 22 through the through hole 503. This makes it possible to connect the pipe proximal end portions of the plurality of inner low-pressure pipes 30 disposed at an inner side than the cover plate 50, that is, disposed in the space between the cover plate 50 and the left side surface 221 of the second boom component 22, to the plurality of first connection ports 61 as illustrated in FIG. 7.

The plurality of second connection ports 62 are formed on the second side surface 602 (outer surface) of the pressure release connector 60. End portions of a plurality of branch pipes 65 branched from the plurality of outer high-pressure pipes 40 are connected to the plurality of second connection ports 62, respectively.

The plurality of third connection ports 66 are formed on the third side surface 603 of the pressure release connector 60. Pipe distal end portions 302 (an example of an outer end portion) of a part of the outer low-pressure pipes 30A among the plurality of outer low-pressure pipes 30A are connected to the plurality of third connection ports 66, respectively. Thus, the outer low-pressure pipe 30A is coupled to the inner low-pressure pipe 30 via the pressure release connector 60.

The plurality of pressure release connection ports 63 and 64 are formed on the fourth side surface 604 of the pressure release connector 60. The plurality of pressure release connection ports 63 are provided for releasing the pressure inside the inner low-pressure pipe 30 and the outer low-pressure pipe 30A, and the plurality of pressure release connection ports 64 are provided for releasing the pressure inside the plurality of outer high-pressure pipes 40. Each of the plurality of pressure release connection ports 63 and 64 has a shape connectable with an end portion of a hose (not illustrated). When the hose is connected to any one of the plurality of pressure release connection ports 63 and 64, at least a part of the hydraulic oil inside the corresponding pipe is discharged to the outside through the hose. As a result, the pressure inside the pipe decreases.

As illustrated in FIG. 3, FIG. 5, and FIG. 6, the pressure release connector 60 is located at a lower end portion of the cover plate 50 in a state where the second boom component 2 is disposed to have the fallen attitude. Specifically, as illustrated in FIG. 3 and FIG. 8, each of the plurality of pressure release connection ports 63 and 64 is disposed below the plurality of outer high-pressure pipes 40 in a state where the second boom component 2 is disposed to have the fallen attitude. As a result, an operator can easily perform pressure releasing work using the hose as described above.

The low-pressure pipe connector 71 is a connector enabling a part of the plurality of inner love-pressure pipes 30 and a part of the plurality of outer low-pressure pipes 30A to be coupled. The inner low-pressure pipe 30 and the outer low-pressure pipe 30A other than those connected to the pressure release connector 60 are connected to the low-pressure pipe connector 71.

As illustrated in FIG. 6 and FIG. 7, the low-pressure pipe connector 71 includes an inner surface 701 (right side surface in the present embodiment) opposed to the plate outer surface 501 of the cover plate 50, an outer surface 702 (left side surface in the present embodiment) opposite to the inner surface 701, and a side surface 703 connecting the inner surface 701 and the outer surface 702. In the present embodiment, the side surface 703 is a surface facing the first boom component 21.

The low-pressure pipe connector 71 is supported by the cover plate 50. Specifically, the low-pressure pipe connector 71 is disposed at a position closer to the plate proximal end region R1 than to the plate distal end region R3. The low-pressure pipe connector 71 is disposed at a position adjacent to the pressure release connector 60. The low-pressure pipe connector 71 is fixed to the cover plate 50 with the inner surface 701 in contact with the plate outer surface 501. Therefore, the low-pressure pipe connector 71 is disposed at the outer position (in the leftward direction) than the cover plate 50. In other words, the low-pressure pipe connector 71 is disposed on the side opposite to the plurality of inner low-pressure pipes 30 with respect to the cover plate 50.

The low-pressure pipe connector 71 has a plurality of inner connection ports 74 and a plurality of outer connection ports 75.

The plurality of inner connection ports 74 are formed on the inner surface 701 of the low-pressure pipe connector 71. The pipe proximal end portions of a part of the inner low-pressure pipes 30 among the plurality of inner low-pressure pipes 30 are connected to the plurality of inner connection ports 74. As illustrated in FIG. 6 and FIG. 7, a through hole 504 is formed in a portion of the cover plate 50 corresponding to the plurality of inner connection ports 74. As a result, the plurality of inner connection ports 74 are exposed to the space between the cover plate 50 and the left side surface 221 of the second boom component 22 through the through hole 504. This makes it possible to connect the pipe proximal end portions of the plurality of inner low-pressure pipes 30 disposed at the inner side than the cover plate 50, that is, disposed in the space between the cover plate 50 and the left side surface 221 of the second boom component 22, to the plurality of inner connection ports 74, respectively, as illustrated in FIG. 7.

The plurality of outer connection ports 75 are formed on the side surface 703 of the low-pressure pipe connector 71. The pipe distal end portions of a part of the outer low-pressure pipes 30A among the plurality of outer low-pressure pipes 30A are connected to the plurality of outer connection ports 75. Thus, the outer low-pressure pipes 30A are coupled to the inner low-pressure pipes 30 via the low-pressure pipe connector 71, respectively.

A low-pressure pipe connector 72 is a connector enabling the plurality of inner low-pressure pipes 30 and the plurality of outer low-pressure pipes 30B to be coupled. As illustrated in FIG. 5 and FIG. 6, the low-pressure pipe connector 72 is supported by the cover plate 50. Specifically, the low-pressure pipe connector 72 is disposed at a position closer to the plate distal end region R3 than to the plate proximal end region R1. More specifically, the low-pressure pipe connector 72 is disposed in a portion on the most distal end side (left side in FIG. 5) of the cover plate 50.

The low-pressure pipe connector 72 includes a plurality of connection ports 76 and a plurality of connection ports 77. The pipe distal end portions of the plurality of inner low-pressure pipes 30 are connected to the plurality of connection ports 76. The pipe proximal end portions of the plurality of outer low-pressure pipes 30B are connected to the plurality of connection ports 77. Thus, the outer low-pressure pipes 30B are coupled to the inner low-pressure pipes 30 via the low-pressure pipe connector 72, respectively.

The pipe proximal end portions of a part of the inner low-pressure pipes 30 among the plurality of inner low-pressure pipes 30 are connected to the pressure release connector 60, and the pipe proximal end portions of the remaining inner low-pressure pipes 30 among the plurality of inner low-pressure pipes 30 are connected to the low-pressure pipe connector 71. The inner low-pressure pipe 30 connected to the pressure release connector 60 is a pipe that needs to be subjected to pressure releasing for reducing the pressure in the inner low-pressure pipe 30 in the assembling work or disassembling work for the work attachment 20.

The pipe distal end portions of a part of the outer low-pressure pipes 30A among the plurality of outer low-pressure pipes 30A are connected to the pressure release connector 60, and the pipe distal end portions of the remaining outer low-pressure pipes 30A of the plurality of outer low-pressure pipes 30A are connected to the low-pressure pipe connector 71. The pipe distal end portions of the plurality of inner low-pressure pipes 30 and the pipe proximal end portions of the plurality of outer low-pressure pipes 30B are connected to the low-pressure pipe connector 72.

Each of the plurality of outer high-pressure pipes 40 is connected to the pressure release connector 60. Specifically, as illustrated in FIG. 3 and FIG. 7, each of the plurality of outer high-pressure pipes 40 is connected to the pressure release connector 60 via the branch pipe 65 branched from the high-pressure pipe connector 40CN attached to the pipe proximal end portion of the outer high-pressure pipe.

As illustrated in FIG. 6, the pipe protection unit UN1 further includes an oil machine 80. The oil machine 80 includes a valve for switching between a supply circuit of hydraulic oil to the pin insertion and removal device and a supply circuit of hydraulic oil to the hydraulic motor for rotation. Some inner low-pressure pipes 30 among the plurality of inner low-pressure pipes 30 are connected to the oil machine 80. The oil machine 80 includes a lever 81. The operator can conduct switching between the two supply circuits by operating the lever 81. The two supply circuits may share a part of the pipes. The pin insertion and removal device and the hydraulic motor for rotation arc operated by, for example, an operation device near the driver's seat in the cab 12A. Although not illustrated, an oil machine other than the oil machine 80 may be disposed in the inner space between the cover plate 50 and the left side surface 221 of the second boom component 22. In this case, the other oil machine is protected by the cover plate 50.

In the cover plate 50, a through hole 505 is formed in a portion corresponding to the oil machine 80. The oil machine 80 is fixed to the plate outer surface 501 of the cover plate 50. The oil machine 80 has an inner surface opposed to the plate outer surface 501 of the cover plate 50 and an outer surface opposite to the inner surface. A plurality of connection ports are formed on the inner surface of the oil machine 80, and the plurality of inner low-pressure pipes 30 are connected to the connection ports through the through hole 505. Since the lever 81 of the oil machine 80 is disposed at the outer position (in the leftward direction) than the cover plate 50, the operator can easily operate the lever 81.

Figure 11:
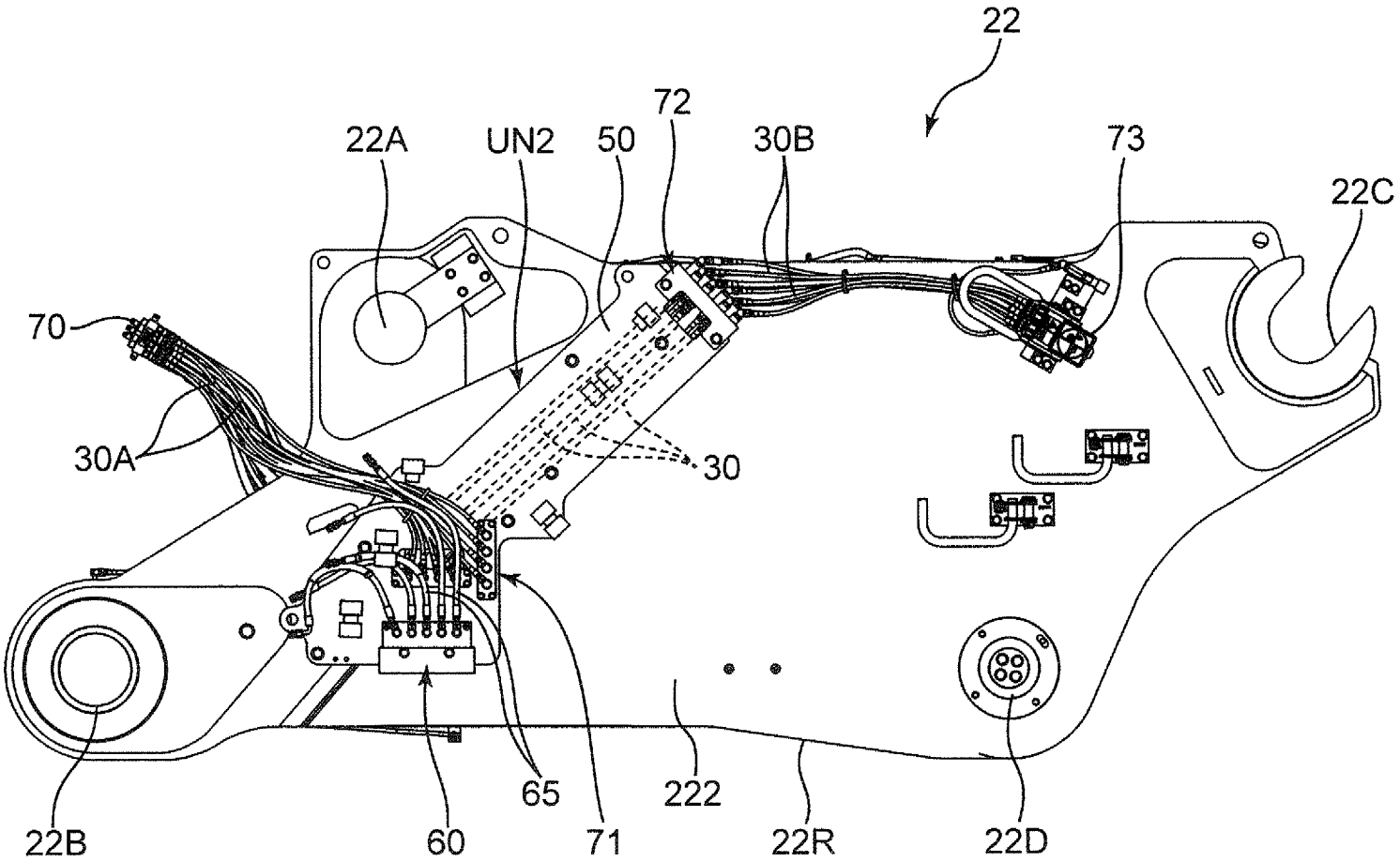
FIG. 11 is a right side view illustrating the boom component, the plurality of low-pressure pipes, and the cover plate.

In the right side view of FIG. 10, the second boom component 22, a plurality of high-pressure pipes, a plurality of low-pressure pipes, and a cover plate 50 are illustrated. FIG. 11 is a right side view in which illustration of the plurality of high-pressure pipes in FIG. 10 is omitted.

The pipe protection unit UN2 illustrated in FIG. 10 and FIG. 11 has a basic structure similar to that of the pipe protection unit UN1 described above. Specifically, the pipe protection unit UN2 includes a plurality of low-pressure pipes, a plurality of high-pressure pipes, and a cover plate 50. The plurality of low-pressure pipes include, for example, the plurality of inner low-pressure pipes 30 as shown in FIG. 11, and the plurality of high-pressure pipes include, for example, the plurality of outer high-pressure pipes 40 as shown in FIG. 10. The plurality of inner low-pressure pipes 30 are hydraulic pipes disposed along the right side surface 222 (an example of an attachment side surface) of the second boom component 22. The plurality of outer high-pressure pipes 40 are hydraulic pipes disposed along the right side surface 222 at the outer position than the plurality of inner low-pressure pipes 30. The plurality of outer high-pressure pipes 40 have an outer diameter larger than that of the plurality of inner low-pressure pipes 30. The cover plate 50 is a plate that is disposed along the right side surface 222 so as to be interposed between the plurality of inner low-pressure pipes 30 and the plurality of outer high-pressure pipes 40 and is supported by the work attachment 20. The cover plate 50 covers at least a part of each of the plurality of inner low-pressure pipes 30.

Figure 13:
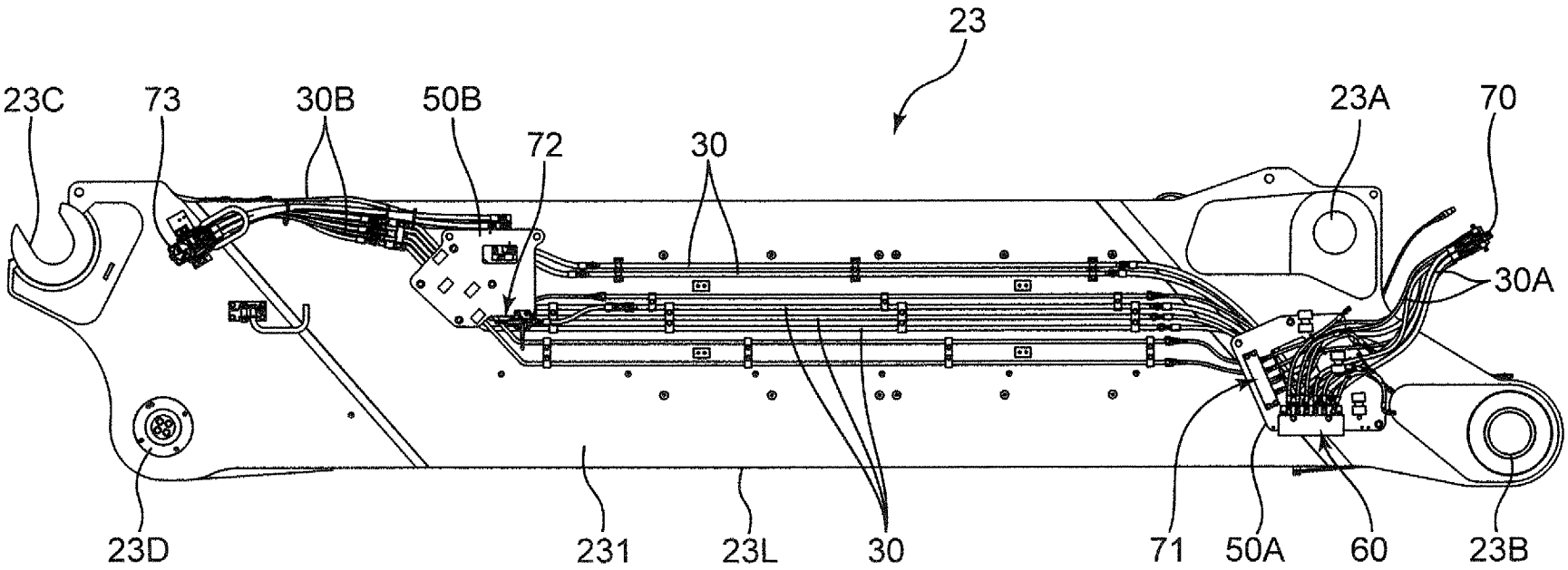
FIG. 13 is a left side view illustrating the other boom component, the plurality of low-pressure pipes, and the two cover plates.

In FIG. 12, the third boom component 23, a plurality of high-pressure pipes, a plurality of low-pressure pipes, and two cover plates 50A and 50B are illustrated. FIG. 13 is a left side view in which illustration of the plurality of high-pressure pipes in FIG. 12 is omitted.

Since the pipe protection unit UN3 illustrated in FIG. 12 and FIG. 13 has the same basic structure as the pipe protection unit UN1 described above, no detailed description thereof will be made. The pipe protection unit UN3 is different from the pipe protection unit UN1 in that the pipe protection unit UN3 includes the plurality of cover plates 50A and 50B.

Each of the cover plates 50A and 50B is a plate that is disposed along the attachment side surface so as to be interposed between the plurality of inner low-pressure pipes 30 and the plurality of outer high-pressure pipes 40 and is supported by the work attachment 20. Each of the cover plates 50A and 50B covers at least a part of each of the plurality of inner low-pressure pipes 30. The cover plate 50A and the cover plate 50B are spaced apart from each other. The cover plate 50A covers the pipe proximal end portions of the plurality of inner low-pressure pipes 30 and the vicinity thereof. The cover plate 50B covers the pipe distal end portions of the plurality of inner low-pressure pipes 30 and the vicinity thereof.

The pipe protection unit UN3 further includes a cover 55. The cover 55 covers not only the plurality of inner low-pressure pipes 30 but also a part of the plurality of high-pressure pipes 40. The cover 55 can be omitted.

As described above, in each of the pipe protection units UN1, UN2, and UN3 according to the present embodiment, the plurality of inner low-pressure pipes 30 are respectively protected by the plurality of outer high-pressure pipes 40 having high strength and disposed at the outer position than the inner low-pressure pipes 30, and by the cover plate 50 interposed between the plurality of inner low-pressure pipes 30 and the plurality of outer high-pressure pipes 40 and covering at least a part of each of the plurality of inner low-pressure pipes 30.

Since each of the pipe protection units UN1, UN2, and UN3 further includes the pressure release connector 60 supported by the cover plate 50, each of the pipe protection units UN1, UN2, and UN3 is allowed to concentrate the portions for releasing the pressures inside the outer high-pressure pipe 40 and the inner low-pressure pipe 30 at the pressure release connector 60. In other words, the operator can perforin the pressure releasing work for the outer high-pressure pipe 40 and for the inner low-pressure pipe 30 at one place. As a result, in the disassembling work of the work attachment 20 performed by the operator using, for example, a high-place work vehicle, workability of the pressure releasing work for the outer high-pressure pipe 40 and the inner low-pressure pipe 30 is improved. On the other hand, in a case where the pipe protection unit has a plurality of portions for releasing the pressures inside the outer high-pressure pipe 40 and the inner low-pressure pipe 30, it is necessary to move the high-place work vehicle for each of the plurality of portions, and unfold and fold a table on which the operator gets on in the high-place work vehicle for each of the plurality of portions, which takes time and effort.

The pressure release connector 60 is disposed at a position corresponding to a lower portion of the cover plate 50 in a state where the work attachment 20 is disposed to have the fallen attitude that is an attitude in which the work attachment 20 extends along the ground G. Therefore, in the vicinity of the left side surface or the right side surface of the work attachment 20 disposed to have the fallen attitude, the operator can further easily perform the pressure releasing work of releasing the pressures inside the outer high-pressure pipe 40 and the inner low-pressure pipe 30 from the plurality of pressure release connection ports 64 (high-pressure pipe pressure release ports) and the plurality of pressure release connection ports 63 (low-pressure pipe pressure release ports) of the pressure release connector 60.

The plurality of pressure release connection ports 64 and the plurality of pressure release connection ports 63 are disposed below the outer high-pressure pipe 40 located at the lowest position among the plurality of outer high-pressure pipes 40 in a state where the work attachment 20 is disposed to have the fallen attitude. Therefore, when the operator connects the hose to the pressure release connection port 64 and the pressure release connection port 63 in the vicinity of the left side surface or the right side surface of the work attachment 20 disposed to have the fallen attitude, the plurality of outer high-pressure pipes 40 do not interfere, so that the workability of the pressure releasing work is further improved.

In the present embodiment, the plurality of inner low-pressure pipes 30 are disposed in an inner space which is a space between the cover plate 50 and the attachment side surface, and the inner end portions of the inner low-pressure pipes 30 can be connected to an inner connection port formed on an inner surface (inner surface facing the attachment side surface) of the pressure release connector 60. Then, since the pressure release connector 60 is fixed to the plate outer surface 501 of the cover plate 50, it is not necessary to secure a space for disposing the pressure release connector 60 in the inner space. This makes it possible to suppress an increase in the inner space. In addition, since the pressure release connector 60 is fixed to the plate outer surface 501 of the cover plate 50, the work of attaching the pressure release connector 60 to the cover plate 50 is facilitated.

Since the cover plate 50 has the through hole 503 formed in a region corresponding to the inner connection port, the inner end portion of the inner low-pressure pipe 30 can be connected to the inner connection port of the pressure release connector 60 through the through hole 503 while the pressure release connector 60 is disposed within the range of the cover plate 50 in side view.

The pressure release connector 60 further has an outer connection port as a connection port which is disposed at the outer position than the cover plate 50 and to which the outer end portion is connected. Specifically, the pressure release connector 60 can not only release the internal pressure of the inner low-pressure pipe 30 but also couple the inner low-pressure pipe 30 to the outer low-pressure pipe 30A. The inner low-pressure pipe 30 and the outer low-pressure pipe 30A constitute a part of the low-pressure piping circuit, and the pressure release connector 60 can lead a part of the low-pressure piping circuit from the inner side to the outer side of the cover plate 50.

Each of the pipe protection units UN1, UN2, and UN3 further includes a plurality of fixing portions for fixing the plurality of outer high-pressure pipes 40 to the cover plate 50. Since the plurality of outer high-pressure pipes 40 are fixed to the cover plate 50, handling of each of the pipe protection units UN1, UN2, and UN3 becomes easy in the work of attaching each of the pipe protection units UN1, UN2, and UN3 to the attachment side surface and the work of detaching each of the pipe protection units UN1, UN2, and UN3 from the attachment side surface.

Each of the pipe protection units UN1, UN2, and UN3 further includes a plurality of flexible high-pressure pipes 40F connected to the plurality of outer high-pressure pipes 40 and having flexibility. One end portion of the flexible high-pressure pipe 40F is stably supported by the cover plate 50 via the outer high-pressure pipe 40 fixed to the cover plate 50, and the flexible high-pressure pipe 40F itself has flexibility. This facilitates the work of connecting the flexible high-pressure pipe 40F to another high-pressure pipe and the work of detaching the flexible high-pressure pipe 40F from the other high-pressure pipe.

In the present embodiment, each of the pipe protection units UN1, UN2, and UN3 can be assembled in advance before being attached to the attachment side surface of the work attachment 20. This improves ease of assembly of each pipe protection unit.

Since in the present embodiment, the plurality of outer high-pressure pipes 40 are fixed to the cover plate 50 and the plurality of inner low-pressure pipes 30 are supported by the cover plate 50 via the plurality of connectors 71 and 72, it is not necessary to perform welding for fixing these pipes to the attachment side surface. As a result, the number of welded portions on the attachment side surface can be reduced. This makes it possible to reduce cost by simplifying the welding work and to reduce a strength risk of the attachment.

In the present embodiment, the inner low-pressure pipe 30 can be guided to the outside of the cover plate 50 via the connector 60 and the connector 71. Therefore, the inner space can be reduced, the pipes can be easily routed, and the pipe protection unit can be easily assembled.

Since in the present embodiment, the pressure release connector 60 is disposed at the outer position than the cover plate 50, the pressure releasing work is facilitated.

[Modifications]

Although the work machine according to the embodiment of the present disclosure has been described above, the present disclosure is not limited to the above embodiment, and includes, for example, the following modifications.

(A) Work Machine

A work machine to which the pipe protection unit according to the present disclosure is applied is not limited to the demolition machine, and may be another work machine such as a hydraulic excavator.

(B) Distal End Work Device

Although the distal end work device in the above embodiment is a crushing device, the distal end work device in the present disclosure may be another distal end work device such as a breaker, a lifting magnet, or a bucket.

(C) Pipe Protection Unit

Although the work machine 100 according to the above embodiment includes a plurality of pipe protection units, the work machine may include at least one pipe protection unit according to the present disclosure.

(D) Work Attachment

Although the work attachment 20 according to the above embodiment includes the boom 20A, the coupling member 25, the arm 20B, and the distal end work device 28, the coupling member 25 can be omitted. In this case, the arm is rotatably attached to the distal end portion of the boom.

(E) Inner Low-Pressure Pipe and Outer High-Pressure Pipe

Although in the above embodiment, the plurality of inner low-pressure pipes 30 are disposed at the inner position than the cover plate 50, and the plurality of outer high-pressure pipes are disposed at the outer position than the cover plate 50, the present invention is not limited to such an embodiment. At least one inner low-pressure pipe 30 may be disposed at the inner position than the cover plate 50, and at least one outer high-pressure pipe 40 may be disposed at the outer position than the cover plate 50.

(F) Pressure Release Connector

The pressure release connector may be supported not by the cover plate 50 but by a portion of the attachment side surface opposed to the cover plate 50.

The present disclosure provides a pipe protection unit enabling a low-pressure pipe to be protected in a work machine.

Provided is a pipe protection unit in a work machine including a base machine and a work attachment supported by the base machine, the pipe protection unit including: at least one inner low-pressure pipe which is a hydraulic pipe disposed along an attachment side surface which is one of a left side surface and a right side surface of the work attachment; at least one outer high-pressure pipe which is a hydraulic pipe disposed along the attachment side surface at an outer position than the at least one inner low-pressure pipe, the at least one outer high-pressure pipe having an outer diameter larger than an outer diameter of the at least one inner low-pressure pipe; and a cover plate which is a plate that is disposed along the attachment side surface so as to be interposed between the at least one inner low-pressure pipe and the at least one outer high-pressure pipe and is supported by the work attachment, the cover plate covering at least a part of the at least one inner low-pressure pipe.

In the pipe protection unit, the inner low-pressure pipe is protected by the outer high-pressure pipe having high strength and disposed at the outer position than the inner low-pressure pipe and by the cover plate interposed between the inner low-pressure pipe and the outer high-pressure pipe and covering at least a part of the inner low-pressure pipe.

The pipe protection unit preferably further includes a pressure release connector configured to release a pressure inside the at least one outer high-pressure pipe and release a pressure inside the at least one inner low-pressure pipe, the pressure release connector being supported by the cover plate or a portion of the attachment side surface opposed to the cover plate. In this configuration, a portion for releasing the pressure inside each of the outer high-pressure pipe and the inner low-pressure pipe can be concentrated at the pressure release connector in the pipe protection unit. In other words, the operator can pertain the pressure releasing work for the outer high-pressure pipe and the inner low-pressure pipe at one place. As a result, in the disassembling work for the work attachment performed by the operator using, for example, a high-place work vehicle, workability of the pressure releasing work for the outer high-pressure pipe and the inner low-pressure pipe is improved.

It is preferable that the pressure release connector has a high-pressure pipe pressure release port for releasing the pressure inside the at least one outer high-pressure pipe and a low-pressure pipe pressure release port for releasing the pressure inside the at least one inner low-pressure pipe, and that the pressure release connector is disposed at a position corresponding to a lower portion of the cover plate in a state where the work attachment is disposed to have a fallen attitude that is an attitude in which the work attachment extends along the ground. In this configuration, since the pressure release connector is disposed at the position corresponding to the lower portion of the cover plate in the state where the work attachment is disposed to have the fallen attitude, the operator can further easily perform the pressure releasing work of releasing the pressures inside the outer high-pressure pipe and the inner low-pressure pipe from the high-pressure pipe pressure release port and the low-pressure pipe pressure release port in the vicinity of the left side surface or the right side surface of the work attachment disposed to have the fallen attitude.

It is preferable that the at least one outer high-pressure pipe includes a plurality of outer high-pressure pipes, and that the high-pressure pipe pressure release port and the low-pressure pipe pressure release port are disposed below the outer high-pressure pipe located at a lowest position among the plurality of outer high-pressure pipes in a state where the work attachment is disposed to have the fallen attitude. In this configuration, since the plurality of outer high-pressure pipes do not interfere when the operator accesses the high-pressure pipe pressure release port and the low-pressure pipe pressure release port in the vicinity of the left side surface or the right side surface of the work attachment disposed to have the fallen attitude, the workability of the pressure releasing work is further improved.

It is preferable that the cover plate has a plate outer surface which is an outer surface opposite to the attachment side surface and to which the pressure release connector is fixed, and that the pressure release connector has an inner surface facing the attachment side surface, and an inner connection port which is a connection port formed on the inner surface and to which an inner end portion that is one end portion of the at least one inner low-pressure pipe is connected. In this configuration, the inner low-pressure pipe is disposed in an inner space which is a space between the cover plate and the attachment side surface, and the inner end portion of the inner low-pressure pipe can be connected to the inner connection port formed on the inner surface (inner surface facing the attachment side surface) of the pressure release connector. Then, since the pressure release connector is fixed to the plate outer surface of the cover plate, it is not necessary to secure a space for disposing the pressure release connector in the inner space. This makes it possible to suppress an increase in the inner space. In addition, since the pressure release connector is fixed to the plate outer surface of the cover plate, the work of attaching the pressure release connector to the cover plate is facilitated.

The cover plate preferably has a through hole formed in a region corresponding to the inner connection port. In this configuration, the inner end portion of the inner low-pressure pipe can be connected to the inner connection port of the pressure release connector through the through hole while the pressure release connector is disposed within a range of the cover plate in side view.

It is preferable that the pipe protection unit further includes at least one outer low-pressure pipe which is a hydraulic pipe connected to the at least one inner low-pressure pipe via the pressure release connector, the at least one outer low-pressure pipe having an outer end portion that is one end portion disposed at an outer position than the cover plate, and that the pressure release connector further has an outer connection port which is a connection port disposed at the outer position than the cover plate and to which the outer end portion is connected. In this configuration, the pressure release connector can not only release the internal pressure of the inner low-pressure pipe but also couple the inner low-pressure pipe to the outer low-pressure pipe. The inner low-pressure pipe and the outer low-pressure pipe constitute a part of the low-pressure piping circuit, and the pressure release connector can lead a part of the low-pressure piping circuit from the inside to the outside of the cover plate.

The pipe protection unit preferably further includes a fixing portion for fixing the at least one outer high-pressure pipe to the cover plate, the fixing portion being attached to the cover plate. In this configuration, since the outer high-pressure pipe is fixed to the cover plate, the pipe protection unit can be easily handled in the work of attaching the pipe protection unit to the attachment side surface and the work of detaching the pipe protection unit from the attachment side surface.

The pipe protection unit preferably further includes at least one flexible high-pressure pipe connected to the at least one outer high-pressure pipe and having flexibility. In this configuration, one end portion of the flexible high-pressure pipe is stably supported by the cover plate via the outer high-pressure pipe fixed to the cover plate, and the flexible high-pressure pipe itself has flexibility. This facilitates the work of connecting the flexible high-pressure pipe to another high-pressure pipe and the work of detaching the flexible high-pressure pipe from the other high-pressure pipe.

This application is based on Japanese Patent application No. 2021-069834 filed in Japan Patent Office on Apr. 16, 2021, the contents of which are hereby incorporated by reference. Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A pipe protection unit in a work machine including a base machine and a work attachment supported by the base machine, the pipe protection unit comprising:

at least one inner low-pressure pipe which is a hydraulic pipe disposed along an attachment side surface which is one of a left side surface and a right side surface of the work attachment;

at least one outer high-pressure pipe which is a hydraulic pipe disposed along the attachment side surface at an outer position than the at least one inner low-pressure pipe, the at least one outer high-pressure pipe having an outer diameter larger than an outer diameter of the at least one inner low-pressure pipe; and a cover plate which is a plate that is disposed along the attachment side surface so as to be interposed between the at least one inner low-pressure pipe and the at least one outer high-pressure pipe and is supported by the work attachment, the cover plate covering at least a part of the at least one inner low-pressure pipe.

2. The pipe protection unit according to claim 1, further comprising a pressure release connector configured to release a pressure inside the at least one outer high-pressure pipe and release a pressure inside the at least one inner low-pressure pipe, the pressure release connector being supported by the cover plate or a portion of the attachment side surface opposed to the cover plate.

3. The pipe protection unit according to claim 2, wherein the pressure release connector has a high-pressure pipe pressure release port for releasing the pressure inside the at least one outer high-pressure pipe and a low-pressure pipe pressure release port for releasing the pressure inside the at least one inner low-pressure pipe, and the pressure release connector is disposed at a position corresponding to a lower portion of the cover plate in a state where the work attachment is disposed to have a fallen attitude that is an attitude in which the work attachment extends along the ground.

4. The pipe protection unit according to claim 3, wherein the at least one outer high-pressure pipe includes a plurality of outer high-pressure pipes, and the high-pressure pipe pressure release port and the low-pressure pipe pressure release port are disposed below the outer high-pressure pipe located at a lowest position among the plurality of outer high-pressure pipes in a state where the work attachment is disposed to have the fallen attitude.

5. The pipe protection unit according to claim 2, wherein the cover plate has a plate outer surface which is an outer surface opposite to the attachment side surface and to which the pressure release connector is fixed, and the pressure release connector has an inner surface facing the attachment side surface, and an inner connection port which is a connection port formed on the inner surface and to which an inner end portion that is one end portion of the at least one inner low-pressure pipe is connected.

6. The pipe protection unit according to claim 5, wherein the cover plate has a through hole formed in a region corresponding to the inner connection port.

7. The pipe protection unit according to claim 2, further comprising:

at least one outer low-pressure pipe which is a hydraulic pipe connected to the at least one inner low-pressure pipe via the pressure release connector, the at least one outer low-pressure pipe having an outer end portion that is one end portion disposed at an outer position than the cover plate, wherein the pressure release connector further has an outer connection port which is a connection port disposed at the outer position than the cover plate and to which the outer end portion is connected.

8. The pipe protection unit according to claim 1, further comprising a fixing portion for fixing the at least one outer high-pressure pipe to the cover plate, the fixing portion being attached to the cover plate.

9. The pipe protection unit according to claim 8, further comprising at least one flexible high-pressure pipe connected to the at least one outer high-pressure pipe and having flexibility.

* * * * *